US010047577B2

(12) United States Patent
Bailey

(10) Patent No.: US 10,047,577 B2
(45) Date of Patent: Aug. 14, 2018

(54) SCREENING APPARATUS AND METHOD

(71) Applicant: Axiom Process Ltd., Newcastle upon Tyne (GB)

(72) Inventor: Marshall Graham Bailey, Dubai (AE)

(73) Assignee: Axiom Process Ltd., Tyne & Wear (GB)

( * ) Notice: Subject to any disclaimer, the term of this patent is extended or adjusted under 35 U.S.C. 154(b) by 0 days.

(21) Appl. No.: 15/308,153

(22) PCT Filed: May 1, 2015

(86) PCT No.: PCT/GB2015/051299
§ 371 (c)(1),
(2) Date: Nov. 1, 2016

(87) PCT Pub. No.: WO2015/166282
PCT Pub. Date: Nov. 5, 2015

(65) Prior Publication Data

US 2017/0058621 A1 Mar. 2, 2017

(30) Foreign Application Priority Data

May 2, 2014 (GB) ..... 1407872.9

(51) Int. Cl.
*B07B 1/28* (2006.01)
*E21B 21/06* (2006.01)
*B07B 1/46* (2006.01)

(52) U.S. Cl.
CPC ..... *E21B 21/065* (2013.01); *B07B 1/28* (2013.01); *B07B 1/46* (2013.01); *B07B 2201/04* (2013.01); *B07B 2230/01* (2013.01)

(58) Field of Classification Search
CPC ..... B07B 1/28; B07B 1/46; B07B 2201/04; B07B 2230/01
USPC ..... 209/315
See application file for complete search history.

(56) References Cited

U.S. PATENT DOCUMENTS

| | | | | |
|---|---|---|---|---|
| 1,338,227 A | | 4/1920 | Kirksey | |
| 1,363,207 A | | 12/1920 | Rogers et al. | |
| 4,237,000 A | | 12/1980 | Read et al. | |
| 4,276,158 A | | 6/1981 | Gorlitz | |
| 4,306,974 A | * | 12/1981 | Harry | B01D 35/28 210/388 |

(Continued)

FOREIGN PATENT DOCUMENTS

| | | | | |
|---|---|---|---|---|
| CN | 201261014 Y | | 6/2009 | |
| DE | 102007030188 A1 | * | 1/2009 | B07B 1/46 |

(Continued)

*Primary Examiner* — Terrell Howard Matthews
(74) *Attorney, Agent, or Firm* — Dinsmore & Shohl LLP

(57) ABSTRACT

A method for separating solids from a drill cuttings and drilling mud mixture feed in a shale shaker includes providing a shale shaker (1) having a basket (4) including a stack of at least two screen decks (8,8*a*, 8*b*), wherein the screening surfaces (9,9*a*, 9*b*) of the decks are spaced apart and superposed one above the other. A fluid retaining wall (5) and the feed receiving end (12*a*, 12*b*) of the screening surface of the lowest screen deck define a pond region (15). In use of the method a drill cuttings and drilling mud mixture feed (18) forms a pond of solids and liquid in the pond region that immerses a portion of the screening surface at the feed receiving end of each of the two screen decks. Apparatus for use in the method is also described.

56 Claims, 22 Drawing Sheets

(56) References Cited

U.S. PATENT DOCUMENTS

| | | | | | |
|---|---|---|---|---|---|
| 5,683,580 | A * | 11/1997 | Young | B01D 33/0346 209/326 |
| 5,816,413 | A * | 10/1998 | Boccabella | B07B 1/4645 209/399 |
| 7,703,612 | B2 * | 4/2010 | Browne | B01D 21/283 209/311 |
| 9,079,222 | B2 * | 7/2015 | Burnett | B01D 33/0376 |
| 2003/0173268 | A1 | 9/2003 | Watters et al. | |
| 2010/0089652 | A1 | 4/2010 | Burnett | |
| 2011/0084004 | A1 * | 4/2011 | Carr | B07B 1/4663 209/311 |

FOREIGN PATENT DOCUMENTS

| | | | | |
|---|---|---|---|---|
| DE | 102007030188 | A1 | 1/2009 | |
| GB | 2459287 | A | 10/2009 | |
| WO | 03013690 | A1 | 2/2003 | |
| WO | 2007070559 | A1 | 6/2007 | |
| WO | WO-2007070559 | A1 * | 6/2007 | B01D 21/283 |
| WO | 2011135325 | A2 | 11/2011 | |
| WO | WO-2011135320 | A1 * | 11/2011 | B07B 1/46 |
| WO | 2012140398 | A2 | 10/2012 | |
| WO | 2012140398 | A3 | 1/2013 | |

* cited by examiner

SCREENING APPARATUS AND METHOD

RELATED APPLICATION

The instant application is a U.S. National Phase application of International Application Number PCT/GB2015/051299 filed on May 1, 2015, which claims priority to GB 1407872.9 filed on May 2, 2014, both of which are included in their entirety herein by reference.

FIELD

The present disclosure relates to screening arrangements used in vibratory screening machines such as shale shakers as used for example for separating drill cuttings from used drilling mud when drilling operations such as drilling an oil well are being carried out.

BACKGROUND

Whilst screening machines, especially vibratory screening machines such as the so called 'shale shakers' of the oil well drilling industry are used with success in methods of solids/liquids separation, especially classification, there is a need to improve throughput and effectiveness.

During the drilling of an oil well, fluid known as mud is circulated, under pressure, inside the drilling assembly to the drill bit. One of the functions of the drilling mud is to carry the rock cuttings generated during the drilling process at the drill bit, out of the borehole.

When the drilling mud arrives at the drilling rig after use in drilling, the solids fraction of the mud will contain desirable solids and drilled solids. The drilled solids are generally undesirable solids comprised predominantly of rock but can contain metal fragments. The drilled solids are undesirable as these are generally rock cuttings that if allowed to accumulate at increased concentrations result in undesirable effects on the fluid properties of the mud. As the concentrations of drilled solids in a mud increases the fluid properties are affected until the mud becomes unusable and requires replacement or the addition of new mud to dilute the concentration of drilled solids such that the desired fluid properties are restored. The removal and control of the concentrations of drilled solids is generally regarded as a most important activity in contributing to the successful, safe and economic drilling of an oil well, within the planned time and cost. The process of recycling used drilling mud should remove drilled solids (at least above a selected size range) while leaving desirable solids such as weighting material within the fluid.

Drilled solids are conventionally removed from the mud by using first shale shakers to screen the fluid. Rock cuttings above screen size are removed during screening and the fluid passes into storage tanks for subsequent mechanical and chemical processing, where this is desirable, and ultimate recirculation to the oil well. After screening at the shale shaker, additional solids separation techniques can be applied to remove any drilled solids that have passed through the shale shaker, being smaller than the screen size fitted to the shale shaker.

The drilling mud returning to the drilling rig from a well normally contains a low concentration of drilled solids within a large volume of fluid. The drilled solids removal system is thus required to process a large volume of fluid to remove a small volume of drilled solids. Consequently the size of a drilled solids removal system has historically been directly relative to the volume of fluid to be processed and not the volume of solids to be removed.

One or more shale shakers are used depending upon the volume of fluid being pumped and the separation efficiency required. Generally as finer screens are fitted to the shale shaker the process capacity of the shaker decreases while the efficiency of separation of solids increases. Typically screening will take place using screens (screening material), generally made of woven wire mesh, of between 10 and 400 mesh. These screens will contain between 10 and 400 wires per inch respectively and aperture hole size will vary according to the weave pattern and diameter of the wire used in the weave.

To achieve the required process capacity and separation efficiency, a drilling rig shale shaker installation will typically contain between one and eight shale shakers, although some installations can employ more machines.

The need to design a vibratory screening machine to provide the required fluid throughput while transporting solids to the point of discharge from the screen has resulted in conventional machines being of a larger size or used in greater numbers than is ideal where space and weight are restricted by either physical or economic factors.

Despite the advent of improved screening machines such as high capacity, multi deck shale shakers to improve the throughput, and ability to recycle solids of selected sizes, there is still a need for yet further improved equipment and methods to allow increased separation efficiency and/or modes of operation.

In WO2102/140398 screen assemblies for use in vibratory screening machines such as shale shakers are described. These screening assemblies include first and second screen units one above the other in use and spaced apart by a support frame disposed in between. The screen units include screen panels of screening material through which a feed such as a liquid and solids mixture can be processed. These screening assemblies can increase effectiveness of a given screening machine as a single screening assembly provides two screening surfaces, one above the other through which a liquid and solids mixture can be successively processed. Despite these improvements there remains a need for improved equipment and methods to allow increased separation efficiencies and/or further modes of operation.

SUMMARY

In a first aspect, the present disclosure provides a method for separating solids from a drill cuttings and drilling mud mixture feed, the method comprising:

a) providing a vibratory screening machine, in particular a shale shaker, having a basket including a stack of at least two screen decks, each deck having a screening surface, wherein the screening surfaces of the decks are spaced apart and superposed one above the other; and wherein:

the screening surfaces are each inclined from the horizontal to have a lower, feed receiving, end that is proximal to a fluid retaining wall, and a distal, higher, solids discharge end;

wherein the fluid retaining wall and the feed receiving end of the screening surface of the lowest screen deck of the at least two screen decks define a pond region;

b) providing a drill cuttings and drilling mud mixture feed to the feed receiving end of the at least two screen decks so as to form a pond of solids and liquid in the pond region that immerses a portion of the screening surface at the feed receiving end of each of the two screen decks; and c) operating the shale shaker with a feed rate so as to maintain the pond whilst screening the drill cuttings and drilling mud mixture feed on the screening surfaces.

The pond region includes a portion of the screening surface at the feed receiving end both of the two screen decks so that when the pond is formed at least part of both screening surfaces are submerged in the pond.

Each of the at least two screen decks may be in sealing engagement with the fluid retaining wall so that the mixture may be fully, or substantially fully, successively screened through each screen deck in turn. In this arrangement the screening surface will normally have screen material having aperture or mesh sizes of successively finer cut, from the uppermost to the lowermost screen deck of the stack of at least two. However, in some circumstances the same mesh size may be employed on two or more decks.

The uppermost screen deck removes solids above a selected size with the resulting filtrate then processed on the second screen deck which again removes solids above a selected size but also below the size removed by the upper screen deck. The filtrate resulting from second screen deck has been successively passed through the first, then the second screen deck of the stack of at least two screen decks.

The provision of at least two screen decks with feed receiving ends of the screening surface in a common pond has been found to provide significant benefits in processing capability of a drill cuttings and drilling mud mixture.

These benefits are seen in comparison with the conventional approach where each screen deck forms its own pond and (typically) a flow directing tray is provided between each screen deck so as to direct the filtrate passing down from the screen above to the feed receiving end of the next lower screen deck.

The two screen decks with screening surfaces in a common pond arrangement is more compact than the conventional arrangement and, at the same time has been found to be capable of providing substantially faster processing in terms of solids removal rate for a given feed composition and screen mesh size.

Surprisingly the at least two screen decks with screening surfaces of the two decks in a common pond arrangement, has been found capable of processing a typical drill cuttings and drilling mud mixture feed rapidly.

Without wishing to be bound by theory the head pressure of the fluid in the pond acting on the lowermost screening surface will typically be greater than that found in a conventional shale shaker arrangement and so may aid the screening efficiency especially through the lower (usually finest) screening surface.

The use of a common pond region allows apparatus to be constructed with a lower height whilst maintaining the benefits of successive screening through a series of screening surfaces in a stack. This benefit is enhanced as it has been found that the arrangement described does not require flow directing trays between the screening surfaces, such are typically used in shale shakers to direct the filtrate from one screen deck to the pond end of a subsequent, lower screen deck. Further advantages can be obtained by not providing flow directing trays, (at least not in the pond region) as discussed below.

Whilst benefits of embodiments disclosed and described herein are obtained by providing only two screen decks in the stack and operating with a common pond arrangement, the use of at least three screen decks can provide further benefits whilst maintaining a remarkably low height for multiple deck screening when compared to conventional shale shakers and methods.

With at least three screens in the stack successive screening through the three decks may be obtained allowing improved classification efficiency and the opportunity to obtain sized solids from the middle one of the three screen decks. Such solids have a particle size range determined by the mesh or aperture sizes of the upper screen deck and the second screen deck.

Thus in a second aspect, the present disclosure provides a method for separating solids from a drill cuttings and drilling mud mixture feed, the method comprising:

a) providing a vibratory screening machine, in particular a shale shaker, having a basket including a stack of at least three screen decks, each deck having a screening surface, wherein the screening surfaces of the decks are spaced apart and superposed one above the other; and wherein:

the screening surfaces are each inclined from the horizontal to have a lower, feed receiving, end that is proximal to a fluid retaining wall, and a distal, higher, solids discharge end;

wherein the fluid retaining wall and the feed receiving end of the screening surface of the lowest screen deck of the at least three screen decks define a pond region;

b) providing a drill cuttings and drilling mud mixture feed to the feed receiving end of the at least three screen decks so as to form a pond of solids and liquid in the pond region that immerses a portion of the screening surface at the feed receiving end of at least the lowest and next to lowest screen decks; and c) operating the shale shaker with a feed rate so as to maintain the pond whilst screening the drill cuttings and drilling mud mixture feed on the screening surfaces.

The pond formed in the pond region immerses a portion of the screening surface at the feed receiving end of at least the lowest and next to lowest screen decks. i.e. when the pond is formed and the method operates at least two screen decks will have a portion immersed, providing the benefits of the first aspect of the embodiments disclosed and described herein.

Advantageously the pond region includes a portion of the screening surface at the feed receiving end of all three of the at least three screen decks so that when the pond is formed all three screening surfaces are submerged in the pond.

Each of the screening surfaces of the at least three screen decks may be in sealing engagement with the fluid retaining wall so that the mixture may be fully, or substantially fully, successively screened through each screen deck in turn. In this arrangement the screening surface will normally have screen material having aperture or mesh sizes of successively finer cut, from the uppermost to the lowermost screen deck of the stack of at least three. However, in some circumstances the same mesh size may be employed on two or more screening surfaces, to achieve high efficiency screening or to prevent solids of a particular size range passing through the machine in the event of breakage of the screening surface (e.g. a wire mesh screening surface).

The uppermost screen deck removes solids above a selected size with the resulting filtrate then processed on the second screen deck which again removes solids above a selected size but also below the size removed by the upper screen deck. The third, lowermost, screen deck of the three then receives the filtrate from the second screen deck and in turn removes solids above a selected size but below the size already screened by the second screen deck. The filtrate resulting from third screen deck has been successively passed through the first, then the second then the third screen deck, of the stack of three.

Whilst a stack of more than three screen decks is contemplated, for many processing scenarios no more than three screen levels are required. The shale shaker with three screen decks in the basket can effectively remove solids from the mixture, leaving a cleaned drilling mud that is suitable for reuse in drilling operations, optionally following addition of fresh mud or mud components such as weighting material or sized solids for wellbore strengthening. The provision of at least three screen decks with feed receiving ends of the screening surface in a common pond has been found to provide significant benefits in processing capability of a drill cuttings and drilling mud mixture.

These benefits are seen in comparison with the conventional approach where each screen deck forms its own pond and (typically) a flow directing tray is provided between each screen deck so as to direct the filtrate passing down from the screen above to the feed receiving end of the next lower screen deck.

The three screen decks with screening surfaces in a common pond arrangement is more compact than the conventional arrangement and, at the same time has been found to be capable of providing substantially faster processing in terms of solids removal rate for a given feed composition and screen mesh size.

Surprisingly the three screen decks with screening surfaces in a common pond arrangement, has been found capable of processing a typical drill cuttings and drilling mud mixture feed rapidly.

The apparatus required for the methods discussed above in respect of the first and second aspects of embodiments disclosed and described herein does not require that flow directing trays be used between the screen decks. Contrary to conventional approaches flow directing trays need not be used to prevent filtrate from a screen above rewetting solids as they are freed from the liquid part of the mixture (as they "walk up" the beach region of the screening material of the screen assembly).

Similarly flow directing trays need not be used to direct the filtrate from a screen above to the lowest part of the feed receiving end of the next lower screen. The common pond can operate effectively even with filtrate from a screen above not being specially directed before reaching the part of the pond above the screen below. Solids are "dewatered" by the screening surface (separated from the liquid part of the material being processed) and rapidly move to the solids discharge end of the screening surface.

Indeed it can be beneficial to operate without a flow directing tray or other item that may act as a significant baffle or director of flow within the pond region. Where a flow directing tray is immersed in a pool of fluid above a screening surface, it can cause problems for solids transport out of the pool resulting in solids not immediately transporting out of the pool. Delays can be observed, due to the characteristics of the fluid flow in the pond region, resulting from eddy currents induced by the flow directing tray or other obstruction.

The fluid motion resulting can lead to solids agglomerating into a "pat" or larger mass of solids. When the pat grows to a sufficient size it then is able to walk out of the pool and up the screen to discharge. This gives an intermittent character to the flow of solids up the screening surface to the discharge point. The consequences of these solids build-ups can be reduced fluid throughput, wear to the screen mesh, overloading and damage to the screen mesh and ultimately, in extreme cases, sufficient blockage to cause or require halting of the screening operation in the machine. Thus it is generally preferred that flow directing trays are absent from between screening surfaces in the pond region. However, if desired one or more flow directing trays may be employed outside of the pond region, between adjacent screening surfaces in the stack. Such a flow directing tray can catch residual filtrate passing through the screening surface above and direct it back towards the wet end (the pond region end) of the screening surface below.

Further improvement to the screening process can be obtained by directing the feed carefully onto the pond. The feed is applied from a conduit across the width or substantially across the width of the screening surface at the pond end. The conduit may be shaped so as to direct the flow substantially horizontally or substantially in alignment with the slope of the uppermost screening surface in the direction of the solids discharge ends of the screening surfaces. The flow is directed onto the pond or onto the extreme end of the feed receiving end of the uppermost screening surface in the stack. Advantageously the conduit is arranged to be above the surface of the pond, as a conduit entering into the pond can cause turbulence.

For example the discharge end of the feed conduit is downwards directed and then curves to angle the flow slightly upwards in alignment with the general slope of the uppermost screening surface in a direction towards the solids discharge end of the stack of at least two or at least three screen decks.

Yet further improvements to the screening process can be achieved by the extreme ends of the feed receiving ends of the screening surfaces of the screen decks being in vertical or near vertical alignment. For example the fluid retaining wall is vertical or near vertical and the screen decks are all in sealing engagement with the fluid retaining wall. More advantageously the fluid retaining wall may be inclined from the vertical and sloped downwardly and towards the solids discharge end of the basket. Yet more advantageously as described further hereafter with respect to specific embodiments the fluid retaining wall is at right angles to the general direction of the screening surfaces of the screen decks. Alternatively the fluid retaining wall is stepped downwardly and inwardly towards the solids discharge end of the basket with each screen deck sealing to a step. In this arrangement the feed receiving end of each successively lower screen deck is located closer to the solids receiving end of the basket than the feed receiving end of the screen deck above.

Alternative arrangements to improve solids transport and reduce wear on screening surfaces may be employed in the methods and apparatus described herein and are discussed hereafter with respect to a fifth aspect of embodiments disclosed and described herein.

The screening surfaces are inclined from the horizontal. A typical screen deck arrangement in shale shakers has the screening surface inclined at say 3 to 7 degrees. Such angles can be used with one or more embodiments disclosed and described herein. However a steeper incline has been found more effective in the method of one or more embodiments disclosed and described herein, say from 3 to 15 or even from 7 to 15 degrees, for example 10 to 14 degrees or at or about 12 degrees. The different screen decks may be inclined at different angles or they may be all inclined at the same angle.

Conveniently the angle of the basket including the stack of at least two or at least three screen decks is adjustable by using a jacking mechanism, in the known manner for conventional shale shakers and methods. This adjustment of the basket allows one means of adjustment of the process as conditions vary (e.g. solids content of the feed). For example with difficult to transport solids a reduced angle, closer to the horizontal, may be desirable.

The vibratory motion of the shale shaker is applied both to provide a vertical component, urging the solids and liquid through the screening surface apertures or mesh, and a horizontal component to urge the separated solids from the pond and up to the solids discharge end. This may be achieved for example by applying an elliptical, orbital (circular or near circular), or linear vibratory action or vibratory actions to the basket in the known manner. Combinations of vibratory actions may be employed within the machine, for example elliptical and linear.

Typically an elliptical motion is applied e.g. by a drive mechanism including rotating shafts with eccentric weights, in the known fashion. The amplitude and frequency of vibration and the angle of the vibratory pattern (long axis of the ellipse) are varied to provide efficient solids liquid separation and effective solids transport up the screen to a discharge point. For carrying out the method of one or more embodiments disclosed and described herein, an elliptical vibratory action with a ratio of length to breadth of from 10:1 to 2:1 can be effective. A "g" force of the order of 4 g to 8 g can be applied and the angle of the vibratory pattern may typically vary from 2 to 70 or even 8 to 55 degrees from the horizontal. It will be understood that as the screens are typically inclined as discussed above the "included angle" between the screening surface and the long axis of the vibratory pattern will be less than the angle when described as from the horizontal. An included angle of vibratory pattern of from 2 to 70 degrees may be employed.

Another factor to be considered is the fluid content of the solids discharged from the machine. Where solids are transported quickly across the screening surface face they will tend to have a higher fluid content, when discharged, than comparable solids transported at a slower speed. To assist transport of solids out of the pond while reducing the fluid content of the solids it can be advantageous to design the angle of the vibratory pattern to be higher at the solids discharge end of the machine, say 50 degrees from the horizontal, and lower at the pond end of the machine, say 25 degrees from the horizontal. This may be achieved by arranging the relationships between some or all of the following: the centre of gravity of the machine; the position of the vibrator or vibrators employed; the size of vibratory weights; the mounting method of springs and/or the types of spring employed; and the position of the mass of fluid being processed.

A further factor affecting the fluid content of solids discharged from a screening surface is the design of the screening material. Where it is desirable to reduce the fluid content of the solids discharged a screen of different design may be fitted to the discharge end of the machine compared to that fitted at the feed end (pond end) of the machine.

The fluid retaining wall may be an end wall of a basket of embodiments disclosed and described herein, or it may be provided separately. The fluid retaining wall may be a weir that allows liquid and solids to flow over it depending on the feed rate and constitution and the apertures or mesh size of the screening material employed. The fluid retaining wall may be an end wall of a basket that is provided with an aperture or slot or to allow it to function as a weir, with excess solids and liquid flowing out of the aperture or slot. Even if not an end wall of a basket the fluid retaining wall may make use of an aperture or slot to function as a weir.

Liquid and solids flowing over a weir of the fluid retaining wall will not have been processed by the stack of at least three screen decks. Such an overflow may for example be directed for processing in another shale shaker or another basket of the same shale shaker. For example, in a lower basket of a so called tandem shaker.

Alternatively the overflow may be recycled back to the feed of drill cuttings and drilling mud, for example via a holding tank, for subsequent processing through the stack of at least three screen decks.

Alternatively the weir overflow may be directed to a further stack of at least three screen decks below, in the same basket, and arranged to carry out the method in the same way as the first stack of at least three screen decks, This provides parallel processing with two stacks of at least three screen decks in the same basket.

To form the pond region, the fluid retaining wall has a height that exceeds the height of the screening surface at the feed receiving end of the uppermost screen deck of the stack of at least three i.e. the top of the wall is higher than screening surface at the feed receiving end of the uppermost screen deck. Alternatively where an aperture or slot is provided in the fluid retaining wall, to allow overflow, then the bottom edge of the aperture is above the height of the of screening surface at the feed receiving end of the uppermost screen deck of the stack. As a yet further alternative the aperture is sized so that a restricted flow relative to the expected feed rate is provided, to allow the pond to form in normal use conditions.

The pond that forms in methods of one or more embodiments disclosed and described herein may form in different ways and these can be selected by an operator of the methods and apparatus described herein. The pond may form with a common, horizontal top surface, despite the surface being pierced by the screening surfaces of the screen decks employed. This may be described as a "common pool". As described in more detail hereafter and with reference to FIG. 2, it can be preferred to operate the methods of one or more embodiments disclosed and described herein without a common top surface. For a given feed rate and feed composition the screen mesh sizes of the screening surfaces for each screen deck may be selected from one screen deck to the next to hold differing amounts of fluid on each screen deck. That is to say that the height of the fluid top surface in the pond region on one screen deck may be arranged to be higher than the height of the fluid top surface in the pond region of a lower screen deck. This may be described as a "composite pool" arrangement, which can have the advantage of shortening the required length of the screening surfaces whilst maintaining a good head of fluid in the pond region, allowing faster processing of the fluid through the apparatus employed, especially through lower decks.

Advantageously, where a weir is provided the wall height, or the height of the bottom edge of an aperture in the wall forming a weir, is at a height above the height of the screening surface at the feed receiving end of the uppermost screen deck but below the height of the solids discharge end of the lowest screen deck of the stack of at least three screen decks. This allows overflow at the weir, in conditions of higher feed flow and/or slow filtration through the lowest screen deck, to provide a means of avoiding flooding and loss of fluid from the solids discharge ends of the screen decks.

The fluid retaining wall engages with the feed end of the lowest screen deck to create the pond region where feed can be processed by all three screen decks. Screened (separated) solids will be walked up out of the pond region onto a beach region of each screening surface where further fluid and small particles (passing through the screening surface apertures or mesh) are removed before the separated solids are discharged from the solids discharge end of the deck. Fluid and smaller sized particles passing through a screening surface can then be further processed on subsequent screens in the basket or discharged from the basket for further processing, reuse or disposal as required. Similarly the solids discharged from the solids discharge end of each screen deck may be subject to further processing, reuse or disposal as required.

Solids discharged from the screen decks may fall into a trough or chute or more than one trough or chute that is mounted, partly mounted or not mounted in the basket of the machine.

The screen decks may have different lengths.

Advantageously the solids discharge ends of the screen decks extend to different extents in the horizontal direction at the solids discharge end of the basket. For example where three screen decks are employed the first (upper) screen deck extends the most, the second (middle) screen deck extends less and the third (lowest) screen deck extends the least. This arrangement has the effect that as solids are discharged from the ends of the decks, the solids stream from the first deck can be allowed to fall vertically without interfering with the solids stream discharged from the second deck. The solids discharged from the third screen deck are also not interfered with by the solids from either of the two decks above. This aids separate collection of each of the solids streams as they can, for example, each be allowed to fall vertically off the end or edge of each deck into adjacent collection chutes or other conveyance means for subsequent, independent, further processing, disposal or recycle. The method may include the recycle of the solids discharged from one or other of the screen decks to the drilling mud after it has been screened by the shale shaker. Providing solids discharge ends of the screen decks that extend differently and appropriate collection and/or conveyance means allows this to be done conveniently.

Conveniently screening methods in shale shakers are carried out making use of screen decks using at least some interchangeable (common in general size and structure) components. For example screen panels of screening material that make up screening surfaces or support frames that support screen panels. Thus screen decks in a stack may be of generally equal length which can result in solids discharge ends of decks that are vertically coincident or substantially so. Solids discharged from different screen decks of such an arrangement will fall together unless screen deck extensions are made to one or more of the screen decks.

In typical shale shaker arrangements a number of standard sized screen panels are used to form the screening surface of a screen deck, usually the same number on each deck.

Screen deck extensions may comprise a generally downwards sloping plate, extending in the direction away from the end of the screening surface. The solids discharged from the top of a screening surface slide down the plate and into a collection trough or other collection device below. Alternatively the extensions may comprise a further portion of screening material to allow further dewatering or solvent removal i.e. the screen deck extensions comprise drying screens. Drying may be further assisted by applying a vacuum to the drying screen. In a convenient arrangement, for the methods and apparatus of one or more embodiments disclosed and described herein, and for other screening methods and apparatus, a screen deck extension module is provided.

The module is a third aspect of one or more embodiments disclosed and described herein and is a convenient way of providing extensions to one or more of the screen decks in a screening machine such as a shale shaker. The module may comprise one or more screen deck extensions, to extend the screening surface of screen decks in a stack, mounted in the module housing. The module is mountable, for example by releasable fastenings such as bolts or a clamping system at the solids discharge end of the stack of screen decks. Advantageously the module is mountable in the basket. This arrangement allows the screen deck extensions to benefit from the vibratory action of the basket to aid solids transport. At the same time solids discharged from the module can be discharged into collection troughs, chutes or other collection devices that are below and may be mounted in the basket, or are at least partly mounted in the basket. This allows the vibratory action of the basket to aid in transporting the solids further towards their destination. Alternatively the collection devices may not be mounted on the basket.

The screen deck extension module comprises one or more screen deck extensions such as those described above and where one or more are drying screens may include a vacuum box under a drying screen or all drying screens to aid the process.

Conveniently the screen deck extension module makes use of the same clamping mechanism as employed to clamp the stack of screen decks into the basket of the screening machine.

For screening apparatus according to one or more embodiments disclosed and described herein for use in the methods of one or more embodiments disclosed and described herein a combination of one of the following arrangements:

- extreme ends of the feed receiving ends of the screening surfaces of the screen decks are in vertical or near vertical alignment;
- the fluid retaining wall is vertical or near vertical and the screen decks are all in sealing engagement with the fluid retaining wall;
- the fluid retaining wall is inclined from the vertical and sloped downwardly and towards the solids discharge end of the basket;
- the fluid retaining wall is at right angles to the general direction of the screening surfaces of the screen decks;
- the fluid retaining wall is stepped downwardly and inwardly towards the solids discharge end of the basket with each screen deck sealing to a step;

and at least one of;

- a screen deck extension module;
- the feed is applied from a conduit across the width or substantially across the width of the screening surface at the pond end;
- the feed conduit shaped so as to direct the flow substantially horizontally or substantially in alignment with the slope of the uppermost screening surface onto the pond or onto the extreme end of the feed receiving end of the uppermost screening surface in the stack;
- is advantageous in providing a machine where the processing through the at least two or at least three screen decks can be carried out effectively.

In order to provide the common pond arrangement with gently inclined screening surfaces, that allow sufficient length of screen material to be available to act as the "beach"

end of the screening area of each deck, the screen decks are advantageously close together. This avoids the requirement for long screen decks and a correspondingly long vibratory basket and hence shale shaker. Typically the screening surfaces of the screen decks are spaced apart and parallel. The spacing is sufficient to allow transport of solids separated by a screening surface, off the end of the screen deck. In principle the spacing between screen decks need only be just larger than the size of particles passing through from the screen above but as a bed of particles tends to build up on a screen surface a greater spacing is used to allow substantially free movement of the screened particles up the screening surface to the discharge end.

Typically the spacing between the screening surfaces of adjacent screen decks may be of the order of 20 to 120 mm, for example 30 to 80 mm, or even between 40 and 60 mm.

For example, the lowest of three screen decks may have a screening surface inclined at 7 degrees from the horizontal and the decks may be spaced apart at 50 mm between each deck, at the fluid retaining wall end. With a maximum pond depth of 100 mm on the top screen (i.e. height of fluid between the surface of the pond and the top screen deck at the fluid retaining wall), the horizontal length of the pond on the lowest screen deck of the three will be approximately 1.6 m. This leaves a beach of the order of 1.4 m on the lowest deck, if the screen deck has a 3 m length and assuming the pond has a common horizontal top surface, despite the surface being pierced by the screening surfaces of the screen decks employed. If a composite pool arrangement is made as discussed above then different beach lengths may be obtained on different screen decks.

Typically the lowest screen deck of the stack has a sump or other outlet from the shale shaker below it. The screening surface of the lowest screen deck of the stack defines the bottom of the pond region. In this embodiment, the filtrate that has passed through the screening surface falls through the air to the sump, or other collecting means. Alternatively the pond may continue below the stack of screen decks, for example by a bottom tray that contains some of the filtrate, before it is lead away for reuse, storage or further processing. In this embodiment the contained filtrate is in contact with the rest of the pond liquid (in the pond region) through the screen material of the screening surface of the lowest deck in the stack. This immersion of the lowest screen, with a depth of fluid on both the upper and lower sides can aid in controlling and/or maintaining the pond depth such that solids classification is improved as the dewatering rate is reduced in such an arrangement, at least on the lowermost screening surface. This arrangement can aid in avoiding a bed of solids building up on a screening surface, which leads to a reduction in classification efficiency.

The screen decks include a screening surface which comprises screening material. The screening material allows the passage of liquid and solid particles of a size determined by the mesh or aperture size of the screening material employed. The screening material may be of any type suitable for use in a vibratory screening machine such as a shale shaker for separating solids from a solid and liquid mixture. The screening material is typically provided in the form of one or more screen panels, making up the screening surface.

Typically the screening surface is provided in the form of one or more screen panels comprising, consisting of or consisting essentially of the screening material. Screen panel types for shale shakers generally fall into two groups, those tensioned within the machine and those that are pre-tensioned on a frame such that a screen frame may be clamped or otherwise secured into the shale shaker as a screen assembly without the need to tension the screening material.

Screen panels in screen decks will incorporate screening material which will typically be, but is not limited to, woven wire mesh manufactured from stainless steel, bronze, high tensile steel, or other suitable metal or metal alloys, a suitable plastic or combination of plastics and other materials. Alternatively screening material can be, but not limited to, wedge wire, moulded plastic, perforated metal or plastic. The screening material may be arranged in single or multiple layers according to the aperture size, material type and duty required. If multiple layers are used they are normally arranged such that the upper layer, that will be the first to be contacted by the solid and fluid, and is normally the element with the smallest aperture size, is mounted over progressively stronger elements of increasing aperture size. The second and subsequent layers may be selected not only to provide support for upper layers but to interact with the upper layer so as to reduce the tendency of the upper layer of screening material to suffer from plugging, by particles near to the mesh aperture size. The screen panels will be attached to a component by which the screen is mounted and fixed into the shale shaker.

One example of a conventional un-tensioned screen is commonly referred to as a hook strip screen. Single or multiple layers of mesh are clamped together with hooks attached to either side of the screen panel. When fitted to the shale shaker the hooks engage with suitably shaped hooked tensioning rails. The screen panel is positioned over a suitably spaced and shaped screen support framework. The tensioning rails are provided with a means of tensioning the screen panel (mesh layer or layers). Typically this can be, but is not limited to, bolts and springs. When tensioned the screen is pulled over the support framework to form a supported tensioned screen. The supported and tensioned screen, or more than one screen if a greater area is required, form the screen deck in this example.

An alternative type of typical conventional screen is commonly referred to as a pre-tensioned screen. This will typically be comprised of a rigid or semi rigid support means onto which screening material is fixed. Typical examples of support means are, but are not limited to, a metal or plastic framework, either fabricated, moulded, formed or cast, alternatively a perforated sheet of metal or plastic. Screens may be of single or multiple layers and mesh elements may be un-tensioned, tensioned at different tensions or subject to the same tensioning prior to fixing to the support means. Screen elements (meshes) may be flat or corrugated into a sandwich prior to bonding to the support framework. The pre-tensioned screen and its frame once manufactured generally form a single unit. Fixing methods are typically but not limited to bolting, clamping with wedges, hydraulics or pneumatics or other suitable system.

The screen panels may be planar (in use) or substantially planar in use or they may be for example in the form of a corrugated sheet such as is known in the art. The screening surface that may be formed from one or more screen panels is inclined from the horizontal. For some applications the screen panels may comprise or consist essentially of a mesh panel, for example of a woven wire mesh or a plastic mesh such as mentioned above.

Screen panels may be provided in the form of a pre-tensioned mesh layer or layers of mesh fitted to an apertured plate such as are known in use with shale shakers. For example as described in WO03/013690.

In general where screen panels are of an apertured plate with a mesh attached the mesh may be fitted either above or below the apertured plate (with reference to the in use orientation). Where a mesh is fitted below an apertured plate the plate may act as a baffle, to control fluid and solids flow, through the screen and to control screened solids movement off the plate. Typically the mesh or layers of mesh are fitted above the apertured plates (considered in the in use orientation).

The screen panels may be provided with first and second support members formed and arranged for clamping in use, to a support frame. For example, in the basket of a vibratory screening machine such as a shale shaker, for example in the manner described in WO03/013690, the contents of which are incorporated by reference herein.

The screen panels may be clamped into contact with a support frame and may be tensioned across it when the screen assembly is fitted to the shale shaker. In such examples the support frame may be detachable from the shale shaker or may be permanently secured to the machine.

Alternatively the screen panels may be fixed to a support frame, for example by bonding by adhesive or by welding. Bonding may also be by fusing together by melting. For example a wire mesh cloth as screen panel or one layer of a screen panel may be fused to a plastic or plastic coated support frame, softened by heat. Alternative fixings could include the use of fastenings such as bolts or rivets, for example passing through support members of the screen units and into or through the support frame.

The screen decks may be in the form of a crown deck as often used in conventional shale shaker operations. The screening surface has an arcuate shape, to form a so called 'crown deck'. The screening surface rises to the middle of the screen when traversing from one side of the screen deck to the other. The crown deck arrangement aids in keeping a panel of screening material rigid during vibratory motion and assists in keeping an associated support frame in close contact with the panel, avoiding damage caused by excessive relative motion between the two.

Each screen deck used in apparatus described herein, may be independent from the others, for example each deck having its screen panel or panels mounted on a frame or tensioned across the basket by tensioning devices to form the screening surface. Alternatively common frames or frame elements may be used, interconnecting the decks. For example two screen decks may make use of a common frame, screen panels forming a screening surface of one deck may be supported on a frame which also supports the screening surface of a third deck below, across its underside. As a further alternative all screen decks in a stack may be interconnected, at least when in the basket, for example by use of a frame between the first two screening surfaces in the stack and a second frame between the second and third screen surfaces in the stack and so on if more screen decks are employed.

Interconnection may also be achieved by providing a stack of screen decks for use in the methods of one or more embodiments disclosed and described herein in a unitary form, a screen deck cartridge containing at least two screen decks, each deck having a screening surface, wherein the screening surfaces of the decks are spaced apart and superposed one above the other. The screen decks may be permanently secured together in the cartridge, for example the screening surfaces are bonded to support frame(s) that space the screening surfaces apart. Alternatively they may be releasably fitted, for example by releasable fixings, into the cartridge. This allows dismantling for repair or refurbishment. The screen deck cartridge may then be inserted into the basket of a shale shaker or other vibratory screening machine.

Typically screening will take place using screens, generally made of woven wire mesh, of between 10 and 400 mesh. These screens will contain between 10 and 400 wires per inch respectively and aperture hole size will vary according to the weave pattern and diameter of the wire used in the weave. Thus with a stack of only three screens in the method of one or more embodiments disclosed and described herein screen mesh sizes may typically be as follows:

Solids recovery operations: Top 10-30 mesh. Middle 40-100 mesh. Bottom 120-400 mesh Processing weighted muds: Top 10-30 mesh. Middle 40-150 mesh. Bottom 100-230 mesh Processing un-weighted muds: Top 10-80 mesh. Middle 40-200 mesh. Bottom 100-400 mesh.

However it will be appreciated that choice of mesh sizes depends on the feed and the outcome desired from the screening process.

The present disclosure also provides in a fourth aspect, a vibratory screening apparatus, in particular a shale shaker, for use in the method of one or more embodiments disclosed and described herein, the apparatus comprising:

a) a basket including a stack of at least two screen decks, each deck having a screening surface, with the screening surface of each deck spaced apart and superposed one above the other, wherein:

the screening surfaces are each inclined from the horizontal to have a lower, feed receiving, end that is proximal to a fluid retaining wall, and a distal, higher, solids discharge end;

wherein the fluid retaining wall and the feed receiving end of the screening surface of the lowest screen deck define a pond region that, in use, includes at least a portion of the screening surface of the feed receiving end of both screen decks;

b) a feed means for supplying a drill cuttings and drilling mud mixture feed to the feed receiving ends of the screening surfaces.

The vibratory screening apparatus may have any or all of the various features discussed above as being optional for use in respect of the methods of one or more embodiments disclosed and described herein. In particular the vibratory screening apparatus may include at least three screen decks as described above with respect to the second aspect of one or more embodiments disclosed and described herein.

The present disclosure provides, in a fifth aspect a shale shaker comprising:

a basket including a stack of at least three screen decks, each deck having a screening surface, with the screening surface of each deck spaced apart and superposed one above the other, wherein:

the screening surfaces of each of the three screen decks have a lower, feed receiving, end that is proximal to a fluid retaining wall of the basket and a distal, higher, solids discharge end;

wherein the screening surfaces of each of the three screen decks are each spaced apart, one from the next in the stack of three, by a spacing of from 20 mm to 120 mm, at their feed receiving ends.

The spacing between one screen deck and the next may be different between the topmost and middle and the middle and lowest of the stack of three.

The shale shaker of the fifth aspect may have any or all of the various features discussed above as being optional for use in respect of the methods of one or more embodiments disclosed and described herein, and the apparatus of other aspects of one or more embodiments disclosed and described herein. In particular the shale shaker may include features as described above with respect to the second aspect of the instant disclosure. Such features include options for vibratory patterns, a further screening surface below the solids discharge end of the lowest screen deck, the absence of flow directing trays between the at least three screen decks, at least in the region where a pond of fluid collects in use of the shale shaker. Other such features include the option of differing spacing between screen decks and different angles of inclination for the screen decks, including different spacings between and/or angles of inclination for screen decks within the same stack of three are contemplated.

The screening surfaces of the at least three screen decks may be spaced apart, one from the next in the stack by a spacing of from 30 mm to 80 mm or even from 40 mm to 60 mm at their feed receiving ends.

In the shale shaker of the fifth aspect, and of the other shale shakers described herein, the feed receiving end of the screening surface of at least one of the screen decks provided may be spaced away from the fluid retaining wall by a fluid retaining surface extending between the fluid retaining wall and the feed receiving end of a respective screening surface.

In the shale shaker of the fifth aspect of the instant disclosure or other shale shakers described herein having at least three screen decks, the feed receiving ends of the screening surfaces of the lowest two of the three screen decks may be spaced away from the fluid retaining wall by a fluid retaining surface extending between the fluid retaining wall and the feed receiving end of a respective screening surface. Alternatively the feed receiving ends of the screening surfaces of all three of the three screen decks are spaced away from the fluid retaining wall by a fluid retaining surface.

The fluid retaining surfaces provided space the screening surface (e.g. mesh panel) of the respective screen deck away from the fluid retaining wall. Screening surfaces on screen decks provided with a fluid retaining surface may be in sealing contact with the edge of the fluid retaining surface distal to the fluid retaining wall. The edges of the fluid retaining surface proximal to the fluid retaining wall may be in sealing contact with the fluid retaining wall. This allows full successive screening through each screen deck in turn.

The fluid retaining wall, the fluid retaining surface and the feed receiving end of the screening surface of the lowest screen deck can define a pond region that, in use, includes at least a portion of the screening surface of the feed receiving end of at least the lowest two screen decks of the stack of at least three screen decks. Thus the shale shaker of the fifth aspect of the instant disclosure may be employed in the methods of one or more embodiments disclosed and described herein employing a common pond region to process a used drilling mud feed.

Advantageously flow directing trays are not provided between each screen deck as in a typical multi deck shale shaker, at least not in the pond region produced in use of the apparatus. Flow directing trays in conventional shale shakers are used to direct filtrate to the feed receiving end of the screen below. They also aid in preventing wear or even breakage to a lower screening surface by deflecting filtrate (liquid and solids) from a screening surface above falling directly onto the screening surface below. With the closely spaced screening surfaces of the shale shaker of one or more embodiments disclosed and described herein and the use of the methods involving a common pond described herein such an risk of wear or damage is reduced.

Employing fluid retaining surfaces has been found to provide advantages in terms of processing capability. The feed to the shale shaker and the passage of filtrates through each successive screen deck at the pond region can be subject to turbulence and eddy currents in the pool of fluid above each screen deck. even if the feed to the apparatus is relatively consistent. With a shale shaker, variation in feed content and flow rate is expected as a matter of course. The results of this situation can be rapid wear to screening surfaces, especially where fine meshes are employed.

The use of fluid retaining surfaces that space the feed receiving end of a screening surface away from the fluid retaining wall has been found to greatly reduce wear to the screening surface, avoiding downtime required to change worn screens and cost of replacing screening surfaces. A fluid retaining surface may be used on the uppermost screen deck but may not always be required. The uppermost screening surface is typically of a coarser aperture size and therefore can be made stronger and less susceptible to wear.

The fluid retaining surfaces extend between the fluid retaining wall and the feed receiving end of a respective screening surface. The fluid retaining surface may be a plate permanently fixed (e.g. welded) to the fluid retaining wall. When screening surfaces (e.g. screen panels that may be attached to a support frame) are inserted into the basket of the shale shaker they contact the edge of the fluid retaining plate distal to the fluid retaining wall. A suitable sealing arrangement can be provided between the extreme edge of the screening surface or associate support frame and the edge of the fluid retaining plate.

Alternatively the fluid retaining surface may be provided as part of a screen panel or its associated support frame if one is employed. For example the fluid retaining surface may be a plate, (typically unperforated) and provided at an end of a screen panel, with a screening surface (e.g. mesh on an apertured plate) making up the rest of the panel. Insertion of the screen panel and associated support frame, if employed, into the basket allows location of the fluid retaining surface between the screening surface and the fluid retaining wall. A suitable sealing arrangement between the fluid retaining surface and the fluid retaining wall may be employed to give sealing contact to avoid loss of fluid between the wall and the surface.

As a yet further alternative fluid retaining surfaces may be provided as separate items (e.g. plates) for location between a fluid retaining wall and screening surface when the screen decks are made up in the basket.

The spacing provided between the fluid retaining wall and the beginning of the screening surface may be of the order of at least 60 mm to 500 mm for example. Typically spacing of from 150 mm to 400 mm or even 250 mm to 350 mm between the fluid retaining wall and the respective screening surface may be made.

The fluid retaining surfaces may extend between the fluid retaining wall and the feed receiving end of a respective screening surface at or at substantially the same angle of inclination from the horizontal as the respective screening surface. Alternatively the surface may extend at right angles from the fluid retaining wall. As a yet further alternative the fluid retaining surface may be inclined downwards from the fluid retaining wall to the feed receiving end of the screening surface.

The fluid retaining surfaces, where provided, may be sized to provide the same spacing between the fluid retaining wall and the corresponding screening surface at each screen deck level. Alternatively different spacing may be used. These can adjust the flow patterns of the fluid and solids at each screen deck level and/or reduce wear.

For example each fluid retaining surface may provide a shorter spacing between wall and screening surface than the plate for the screen deck above. Where this arrangement is used together with the same number of common length screening panels on each deck, and a vertical or near vertical fluid retaining wall, it has some advantage. Length in this context means in the direction between the feed end and the solids discharge end when the screen panel is fitted in a basket. The solids discharge ends of the screen decks extend to different extents in the horizontal direction at the solids discharge end of the basket. The first (upper) screen deck extends the most, the second (middle) screen deck extends less and the third (lowest) screen deck extends the least. This arrangement has the effect that as solids are discharged from the ends of the decks, the solids stream from the first deck can be allowed to fall vertically without interfering with the solids stream discharged from the second deck. The solids discharged from the third screen deck are also not interfered with by the solids from either of the two decks above. This aids separate collection of each of the solids streams as they can, for example, each be allowed to fall vertically off the end or edge of each deck into adjacent collection chutes or other conveyance means for subsequent, independent, further processing, disposal or recycle.

However the opposite arrangement, where each fluid retaining surface provides a longer spacing between wall and screening surface than the plate for the screen deck above may be employed. This arrangement has been shown to provide good throughput, solids transport and reduced screen wear in tests. However, this arrangement, when employed together with the same number of common length screening panels on each deck, and a vertical or near vertical fluid retaining wall, has the potential disadvantage that the solids discharge ends of the screen decks extend in an unfavourable fashion. For example where a fluid retaining surface is provided on each of three screen decks, the first (upper) screen deck extends the least, the second (middle) screen deck extends more and the third (lowest) screen deck extends the most. To prevent solids discharge from one screen deck landing on the deck below, suitably sized screen deck extensions such as discussed above may be employed.

Alternatively different numbers of screen panels and/or different lengths of screen panels may be used to make up the screening surfaces of each screen deck, so as to adjust their lengths to provide the desired configuration at the solids discharge end of the basket. Such an approach may increase the length of one or more of the screening surfaces employed and hence the footprint of the screening machine, but this will also improve throughput of the machine. As described hereafter with reference to a specific embodiment, shortening of the length of a particular lower screen deck may be made without loss of screening surface area by providing a further screening surface at the solids discharge end of a screen deck, situated below the lower screen deck at the discharge end. A flow directing tray may be employed to deflect filtrate from the lower screen deck away from the screening surface sited below its discharge end.

In the shale shaker of the fifth aspect the screening surfaces of each of the three screen decks may be inclined from the horizontal from the lower, feed receiving end, to higher, solids discharge end. Alternatively the screening surface of one or more of the three screen decks may be horizontal or substantially horizontal at the feed receiving end with an inclination provided towards the higher solids discharge end. This arrangement; horizontal and then inclining upwards to the solids discharge end; can be used to hold a common pond as described in the methods of one or more embodiments disclosed herein.

The screening surfaces of shale shakers of one or more embodiments disclosed and described herein may be spaced apart and parallel, or they may be provided at different angles of inclination.

The shale shaker of may be provided with a fourth screen deck, the fourth screen deck having a screening surface spaced apart and superposed above the uppermost screening surface of the stack of at least three screen decks. The fourth screen deck may be horizontal or substantially horizontal. The fourth screen deck is typically mounted above the pond region so as not to be immersed in the common pond forming on screen decks below.

The feed to a shale shaker or other vibratory screening devices described herein is typically by means of a head tank that supplies feed to a chute or conduit, which in turn directs the feed onto the feed receiving end of the basket. Control of the feed to the basket can be by means of a weir or valve or other low control device. In some configurations the feed conduit may be immersed in the pond region above the uppermost screen. However it is generally preferred that the feed conduit is not immersed in the pond as turbulence effects can increase screen wear. The conduit may be provided as a static item i.e. not connected to the vibrating basket, or at least the feed discharge end of the conduit may be connected to the basket, and hence vibrated in use of the apparatus.

Alternatively or additionally the fluid retaining wall may include an outlet such as a weir which can allow overflow of solids and drilling mud mixture to assist in maintaining the pond at the desired size.

A compact assembly of screen decks is desirable to allow the operation of the methods of one or more embodiments disclosed and described herein to be carried out without using disadvantageously long screen decks in the shale shaker. At the same time ready access to the screen panels and/or associate support frames to allow maintenance, repair and replacement is desirable.

Thus in a sixth aspect the present disclosure provides a screen system for use in a basket of a vibratory screening machine, in particular a shale shaker, the screen system comprising:

- spaced apart upper and lower screen deck clamping rails, mounted in use to each of two opposed walls of a basket of a said vibratory screening machine;
- a stack of at least two screen decks for mounting between the upper and lower screen clamping rails, each deck having a screening surface and a support frame below the screening surface, wherein the screening surfaces of the decks are superposed one above the other and spaced apart, when clamped together, by the respective intervening support frame;
- wherein at least one clamping means is operable to raise the stack of at least two screen decks so as to clamp the decks together and between the upper and lower screen deck clamping rails; and
- wherein a rest is provided for the support frame of each screen deck to hold the screen decks in a vertically spaced apart relationship, when the said stack of at least two screen decks is in an unclamped state.

The clamping means employed may be by mechanical, hydraulic or pneumatic means. For example a ram or rams powered by electric motor, or by hydraulic or pneumatic means. Mechanical means may include a cam or cams operable to raise the stack.

The clamping means raises the stack of screen decks. In a particularly convenient form the clamping means comprises at least one inflatable bladder mounted on the lower screen deck clamping rails.

By arranging the clamping action from beneath, when making use of the inflatable bladder or bladders or other clamping means to raise the stack of at least two screen decks into engagement with the upper clamping rails, access to the component parts of the screen decks is improved. When the clamping means is in an unclamped state e.g. the bladder is deflated each screen deck sits on its corresponding rest in a vertically spaced apart relationship from the other screen decks. This allows access to each screen deck for replacement, maintenance and repair.

Conveniently the pairs of upper and lower screen deck clamping rails are mounted to opposite walls of the basket and inclined from the horizontal to provide the lower, feed receiving, end to each screening surface that is proximal to a fluid retaining wall, and the distal, higher, solids discharge end. The angle of inclination can be adjustable by use of a jacking system to raise the solids discharge end of the basket, whether or not the screen deck clamping rails themselves are inclined.

The screen deck clamping rails may be provided at opposite sides of the basket where the screen deck traverses substantially the whole width of the basket. Alternatively where a basket is divided into two parts by a central divider wall, a screening operation may be carried out in each part. Screen deck clamping rails are then provided on either side of the divider wall as well as on the outer wall of the basket.

The upper and lower screen deck clamping rails may be provided as separate items each separately fixed to a wall, for example by bolting or welding. Conveniently the upper and lower clamping rails may be inwardly projecting edges of a generally U shaped, in cross section, elongate member. The bottom of the U is fixed to the wall, for example by bolting or welding. This arrangement fixes the relationship between the upper and lower rails, forming a channel between the arms of the U for clamping the screen decks in place.

It will be appreciated that other clamping systems may be employed to hold a stack of screen decks in a basket to permit operation of the methods of one or more embodiments disclosed and described herein. For example a stack of screens may employ a (conventional) overhead bladder clamping system, where the bladder presses the stack of screens downwards. The advantage of the system of the fifth aspect of the instant disclosure is easy access to change a middle or lower screen without the need to take all screens out of the machine.

The screening surface may be provided in the form of screen panels as discussed above with respect to the other aspects of the instant disclosure. The screening surface may be fixed to its corresponding support frame. Any combination of screening surfaces fixed to a support frame or frames or separate from the support frame or frames may be employed to build the stack of screen decks for use in the methods of one or more embodiments disclosed and described herein. However the use of separate screen panels especially in the form of a pre-tensioned mesh layer or layers of mesh fitted to an apertured plate is convenient. When the clamping means such as a bladder is deflated, an unclamped situation, the screen panels can be readily removed from the machine, without having to disturb the support frames which are sitting on their respective rests when the system of the fifth aspect of the instant disclosure is employed. However if desired the support frame may be removed together with its screen panel or panels. Removal of the screen panel and/or support frames is conveniently carried out from the solids discharge end of the basket.

The screen panels may be provided with spaced apart first and second support members formed and arranged for clamping in use, to the corresponding support frame. The support frame may include spaced apart first and second frame members corresponding to the first and second support members of the screen panel. The clamping arrangement of the screen system can then be employed to simultaneously clamp the screen panel to the corresponding support frame and the stack of screen decks into the basket. Conveniently the clamping engagement between screen panel and support frame may be by one of the means described in the applicant's earlier publication WO03/013690 the contents of which are fully incorporated by reference herein.

Typically two or more screen panels may be used to provide the length of screening material required for a screen deck. In the known manner screen panels may be provided with means for releasable interconnection, such as hook and aperture formations. This allows ready removal of screen panels from the solids discharge end of the machine. Pulling the panel at the solids discharge end withdraws the interconnected set of panels making up the screening surface on the screen deck.

The support frames and screen panels may be used to provide a crown deck arrangement.

In accordance with the sixth aspect of the instant disclosure rests, operable when the system is in an unclamped state (e.g. the bladder is deflated.) are provided for the support frames. A rest may take the form of a pair of rails mounted to opposed walls of the basket. These rails are between the upper and lower screen deck clamping rails and may run parallel with them. Alternatively and conveniently a rest may take the form of two sets of projections, such as pins, running along opposed walls of the basket. These projections are between the upper and lower screen deck clamping rails and each set may run parallel with them. The use of a series of projections reduces the risk of solids accumulating on the rests. The rest for the lowermost support frame in the stack may be conveniently provided by the lower set of screen deck clamping rails. The support frame sits on the lower screen deck clamping rails e.g. on a bladder or bladders mounted on the lower rails.

Where the support frames support screening surfaces in the form of separate screen panels, especially in the form of a pre-tensioned mesh layer or layers of mesh fitted to an apertured plate, then each support frame that has a screening surface of a screen deck below it, is formed to allow the passage of solids as they walk up that lower screening surface.

This can be achieved by providing a support frame where at least one channel is defined between the screening surface and the support frame above, running from the pond (feed) end of the screening surface to the solids discharge end.

Conveniently the support frame comprises a series of spaced apart elongate frame members running in the direction from the feed receiving end to the solids discharge end of the screening surface below. The series of spaced apart elongate frame members define channels there between for the transport of screened solids along the screening surface below.

In such an arrangement transverse support frame members (transverse to the direction of travel of the solids up the screen) may be provided, but raised above the level of the screening surface below or with passages there through to allow solids transport.

The outermost frame members of the series (spaced apart first and second frame members) may provide a seal when clamping is applied, between the edges of the screening surface below and the screening surface above. This seal can act to prevent solids and liquid contacting and possibly accumulating on the rests as discussed below and with reference to a particular embodiment.

Sealing to the fluid retaining wall may be by a sealing member fitted to the feed end of the support fame and including a sealing strip for sealing to a clamping rail running along the fluid retaining wall when the clamping means is operated.

In general support frames used in apparatus described herein may be made of plastics materials or metal. Support frames may be semi-rigid (to allow compliance with discrepancies in screen sizes, frames and/or the fittings in the basket where the screen frames locate in use.

Any feature in one aspect of the instant disclosure may be applied to other aspects of the instant disclosure, in any appropriate combination. For example, apparatus features may be applied to method features and vice versa.

DESCRIPTION OF SOME EMBODIMENTS BY WAY OF EXAMPLE

Figure 1:
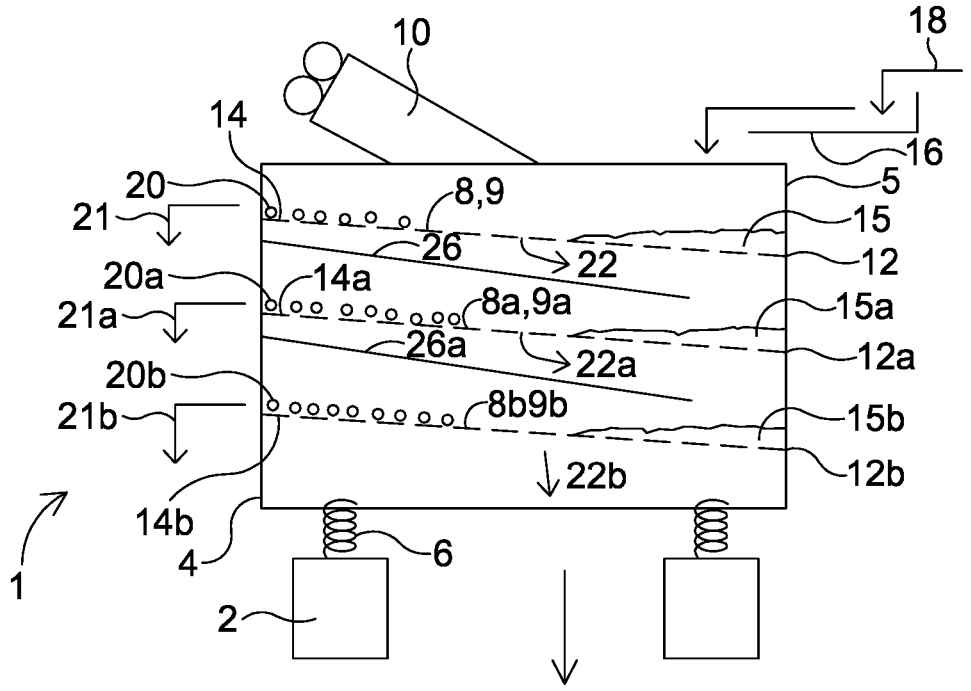
PRIOR ART Fig. 1
FIG. 1 shows prior art screening methods.

FIG. 1 shows in schematic elevation a three deck prior art shale shaker 1. The shale shaker 1 has a base 2 on which is mounted a vibratory basket 4 which has an end wall acting as a fluid retaining wall 5. The basket is mounted by means of springs or rubber mounts 6. Three screen decks 8, 8*a* and 8*b* with their screening surfaces 9, 9*a*, 9*b* indicated by a dashed line, are shown in use. They are stacked one above the other. Vibration means 10 is mounted on top of the basket 4 to provide the vibratory motion.

Typically the screen decks 8, 8*a*, 8*b* would have a screening surfaces 9, 9*a*, 9*b* of one or more panels of a wire mesh or meshes tensioned across a suitable support frame. The screening surfaces will normally have meshes of successively finer cut, to provide progressive screening as an applied mixture of drill cuttings and drilling mud is processed through the machine.

In many operations a screen panel of pre-tensioned wire mesh or meshes mounted on an apertured support plate is clamped and tensioned across a support frame. Typically the support frame is shaped to form the screen panel into a crown deck.

The screen decks as indicated in this figure are at an inclined angle, with a lower end 12, 12*a*, 12*b* and a slightly higher end 14, 14*a*, 14*b*. A pool or 'pond' 15, 15*a*, 15*b* of fluid and solids being screened can form on the lower ends 12, 12*a*, 12*b* of the decks. At an intermediate point on each screen deck the pond ends and the remaining higher end of the screening surface is described as the 'beach' where screened solids are walked up the screening surface to the discharge point (the upper ends 14, 14*a*, 14*b*) by the action of the vibratory means 10, with residual fluid on the solids continuing to drain through the screening surfaces 9, 9*a*, 9*b*.

In use of the shale shaker 1 a used drilling mud fluid including drill cuttings 18 is input to the basket 4 via a conduit 16 acting as a feed chute. Solids 20 of above the aperture size of the screening surface 9 of screen deck 8 are separated off and conveyed by the vibratory action of the vibration means 10, to the end of 14 of the deck 8 from where they can be discharged (with the discharged solids stream 21 indicated by the downwards arrow) for disposal or further processing. Meanwhile the fluid and solids below the aperture size of the screen surface 9 of the deck 8 pass through as indicated by arrow 22 representing the filtrate from deck 8.

Fluid directing tray or flowback pan 26 directs the filtrate 22 passing through screening surface 9 to the lower end 12*a* of the second screen deck 8*a* in the stack. A pond 15*a* is formed and the screening surface 9*a* carries out a second separation stage with solids 20*a* of above the aperture size of the screening surface 9*a* of screen deck 8*a* are separated off and conveyed to the end of 14*a* of the deck 8*a* from where they can be discharged (with the discharged solids stream 21*a* indicated by the downwards arrow) for disposal or further processing.

The fluid and solids below the aperture size of the screen surface 9*a* of the deck 8*a* pass through as indicated by arrow 22*a* representing the filtrate from deck 8*a*.

The third separation step of the three deck shale shaker is carried out by the lowest screen deck 8*b*. The filtrate 22*a* is directed by fluid directing tray 26*a* to for the pond 15*b* on the lower end 12*b* of screen deck 8*b*. Solids 20*a* of above the aperture size of the screening surface 9*b* of screen deck 8*b* are separated off and conveyed to the end 14*b* of the deck 8*b* from where they can be discharged (with the discharged solids stream 21*b* indicated by the downwards arrow) for disposal or further processing.

The filtrate 22*b* that is the liquid and solids that has passed successively through the screening surfaces of all three decks then passes through the bottom of basket 4 to a sump and/or a conduit from where it is conveyed for reuse, further processing or storage.

Arrangements such as those of FIG. 1 have been used successfully, however the requirements for higher throughput have led to the introduction of machines with parallel processing options where the feed is divided and fed more or less simultaneously to two or more screen decks in a stack at the same time. A disadvantage of this approach can be the loss of the opportunity to progressively screen the feed through the same number of screen decks (three or more) as when using the series processing method described above in respect of FIG. 1.

Figure 2A:
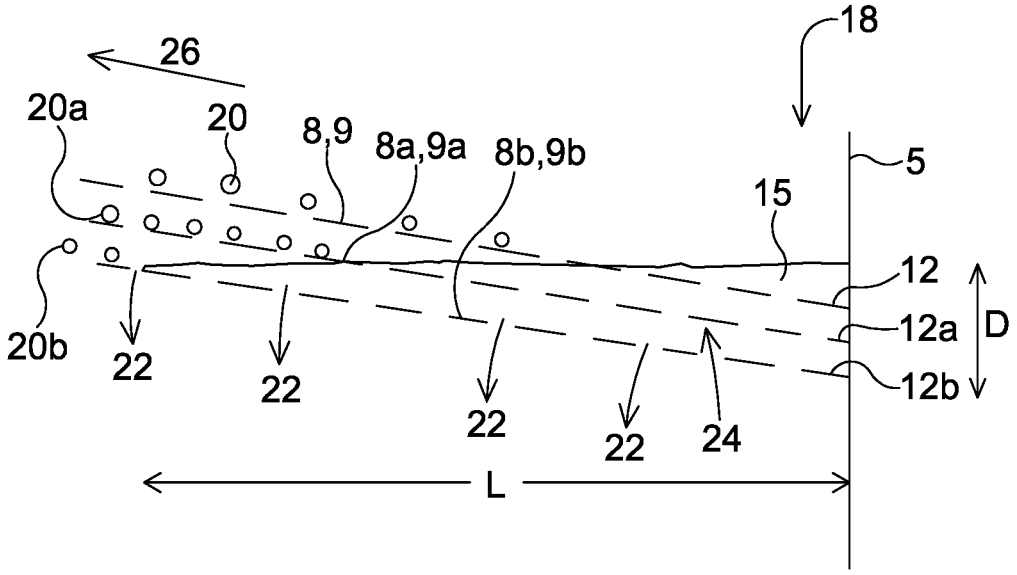
FIG. 2A illustrates a method of screening according to one or more embodiments disclosed and described herein.

FIG. 2A shows in partial schematic cross section the feed receiving end of a shale shaker basket in use with the method of one or more embodiments disclosed and described herein. A stack of three screen decks 8, 8*a*, 8*b* has screening surfaces 9, 9*a*, 9*b* shown as dashed line that are spaced apart and inclined from the horizontal to have lower, feed receiving ends 12, 12*a*, and 12*b*. In this example all three screen decks are in sealing engagement with a fluid retaining wall 5 which may be an end wall of the basket (not shown) that mounts the arrangement depicted.

A drill cuttings and drilling mud feed 18 is applied at the feed receiving ends 12, 12*a*, 12*b* of the screen decks at a rate so as to maintain a pond 15 that includes part of the screening surface 9, 9*a*, 9*b* of each deck. The pond 15 forms in a pond region 24 defined by feed receiving end 12*b* of the screening surface 9*b* of the lowest screen deck 8*b* and the fluid retaining wall. The pond depth D is sufficient at the fluid retaining wall 5 to include a portion of the uppermost screening surface 9*a*. The length of the pond region L is kept shorter than the extent of lowermost screening surface 9*b* to allow solids 20*b* separated on screening surface 9*b* to be dewatered as they move towards the discharge end (not shown) of screen deck 8*b*.

As suggested by arrow 26 the vibratory action of the shale shaker urges the solids 20, 20*a*, 20*b* separated out on the three screening surfaces 9, 9*a* and 9*b* to walk up the decks 8, 8*a*, 8*b* towards discharge ends. At the same time liquid and solids (filtrate 22) passes through all three screen decks for discharge from the bottom of the shale shaker. The solids remaining in the filtrate 22 are those capable of passing through the finest screen material employed in the three screening surfaces 9, 9*a*, 9*b*, which is normally that of the lowest screening surface 9*b*, where the three screening surfaces are of successively finer cut.

The arrangement shown is not provided with fluid directing trays between the screen decks, 8, 8*a*, 8*b* and yet efficient and rapid separation of solids 20, 20*a*, 20*b* from the drilling mud is achieved.

Figure 2B:
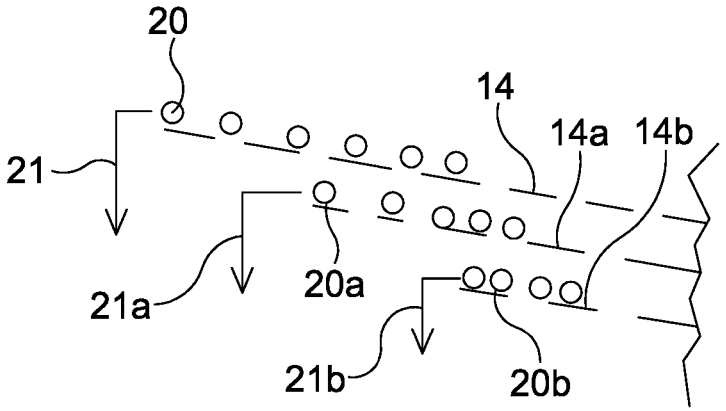
FIG. 2B illustrates a method of screening according to one or more embodiments disclosed and described herein.

FIG. 2B shows in schematic detail the discharge ends 14, 14*a*, 14*b* of the three screen decks 8, 8*a*, 8*b* shown in FIG. 2A. In this example the discharge ends extend to different extents in the horizontal direction so that each of the three streams of solids produced; 21, 21*a* and 21*b* fall independently (not with the solids from another discharge end) thereby allowing the option of collecting one or more of the solids streams separately for recycle to the screened drilling mud, storage, further processing or disposal.

Figure 2C:
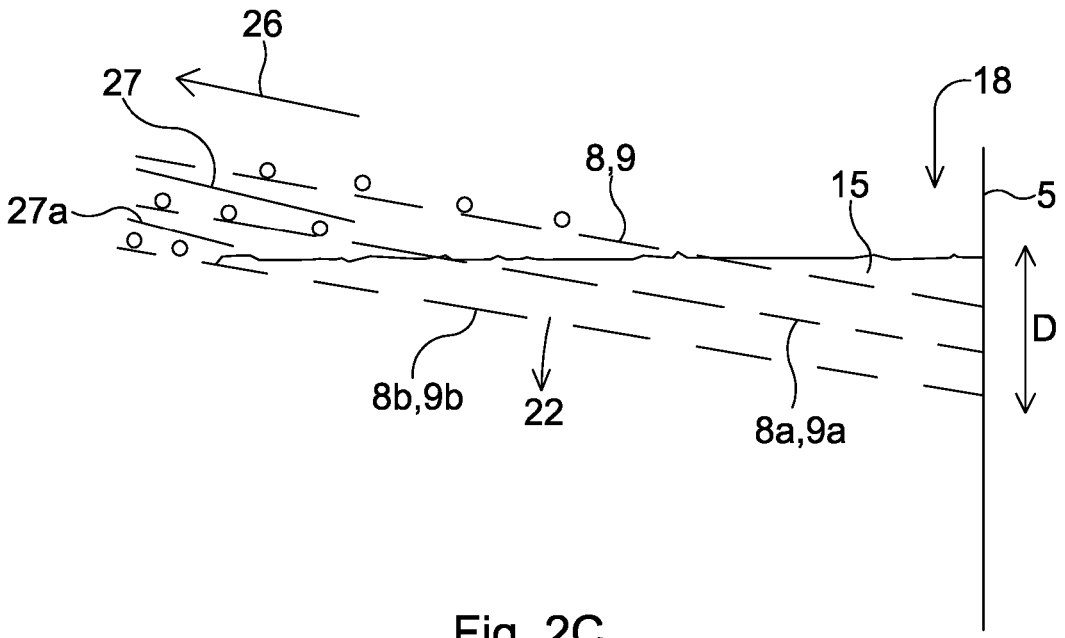
FIG. 2C illustrates a method of screening according to one or more embodiments disclosed and described herein.

FIG. 2C shows an arrangement similar to that of FIG. 2A except that two short flow directing trays 27 and 27*a* are fitted between the adjacent pairs of screen decks 8, 8*a* and 8*a*, 8*b* respectively. These flow directing trays are not in the pond region 24 to avoid giving a baffling effect that can obstruct smooth processing. The flow directing trays act to catch filtrate from the beach area of the deck above and direct it towards the pond 15, avoiding excessive rewetting of solids that are dewatering as they walk up the screen below to discharge.

Figure 2D:
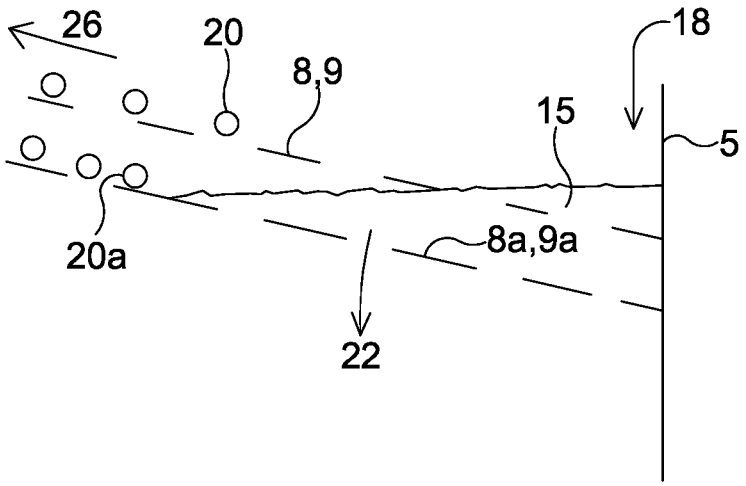
FIG. 2D illustrates a method of screening according to one or more embodiments disclosed and described herein.

FIGS. 2A to 2C described above depict a three screen deck arrangement. A two screen deck arrangement in accordance with one or more embodiments disclosed and described herein and with like parts numbered the same is shown in FIG. 2D.

The partial schematic cross section of FIG. 2A suggests that a common, horizontal, top surface is formed on the pond region 15, despite that surface being pierced by the screening surfaces. This may be described as a "common pool" In practice; it is preferred to operate without a common top surface to the screening surfaces. The screening surfaces 9, 9*a* and 9*b* of the screen decks, are usually of successively finer cut. For a given feed rate and feed composition the screen mesh sizes may be selected to hold differing amounts of fluid on each screen deck i.e. the height of the fluid top surface in the pond region on one screen deck may be higher than the height of the fluid top surface in the pond region of a lower screen deck. This may be described as a "composite pool" arrangement.

Figure 2E:
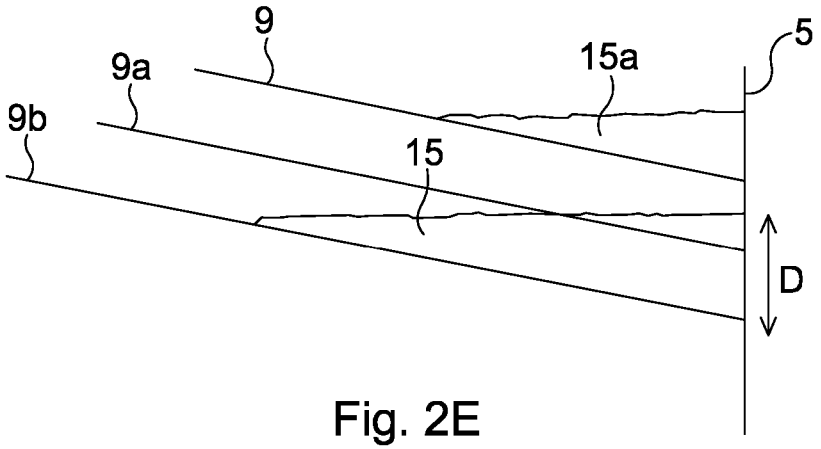
FIG. 2E illustrates a method of screening according to one or more embodiments disclosed and described herein.
Figure 2F:
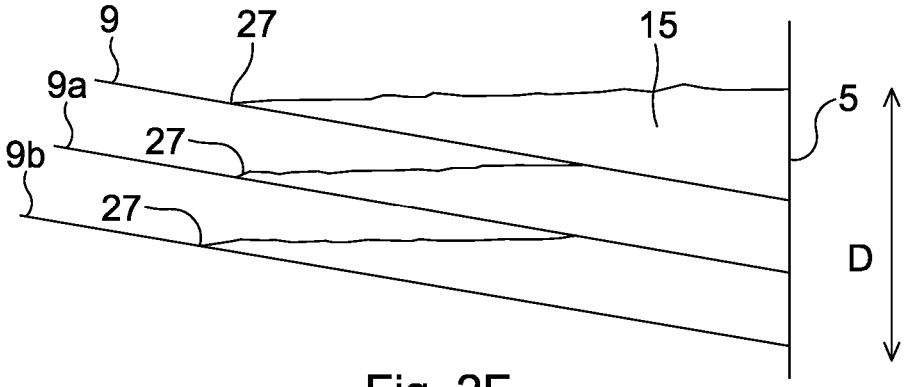
FIG. 2F illustrates a method of screening according to one or more embodiments disclosed and described herein.
Figure 2G:
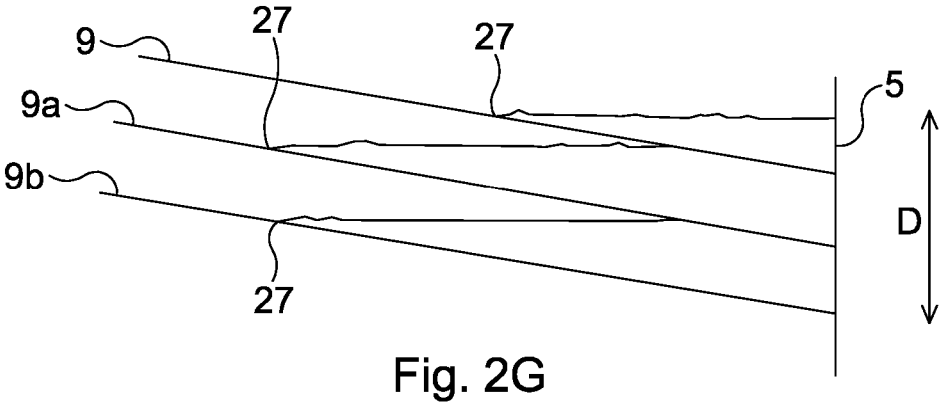
FIG. 2G illustrates a method of screening according to one or more embodiments disclosed and described herein.

Typical situations are shown in the partial schematic cross sections of FIG. 2E to 2G where a common pond 15 is formed on at least the lowermost two screening surfaces 9*a* and 9*b*. In these figures the screening surfaces 9, 9*a* and 9*b* are shown as solid lines for clarity. In FIG. 2E pond 15 forms above screening surfaces 9*a* and 9*b* with a separate pond 15*a* forming on the uppermost screening surface 9.

In FIG. 2F a common pond 15 forms above the screen surfaces 9, 9*a* and 9*b* but the beach (not flooded) part of each screen starts at approximately the same place 27 along the length of the screening surfaces from the fluid retaining wall 5. FIG. 2G shows a situation where the start of beach 27 formed varies amongst the screening surfaces 9, 9*a* and 9*b*. Where the situation is as shown in these figures the benefit of an increased depth of fluid D (head pressure) on at least the lowermost (generally finest) screen are still realised. The depth D at the feed receiving end of the screening surfaces 9, 9*a* and 9*b* can be greater than that of a situation in accordance with FIG. 2A. At the same time the beach lengths of lower screens are longer and so a machine can be constructed with a shorter length whilst maintaining a good dewatering capability (relatively rapid throughput of liquid leaving the solids discharged, relatively dry.

Figure 2H:
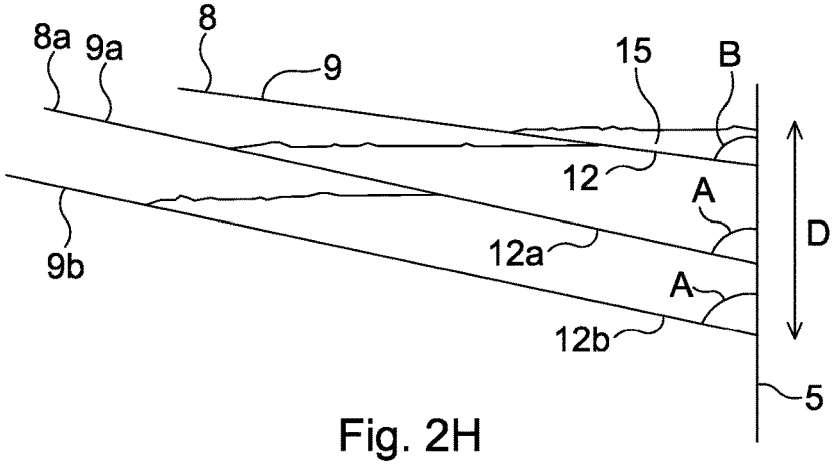
FIG. 2H illustrates a method of screening according to one or more embodiments disclosed and described herein.
Figure 2I:
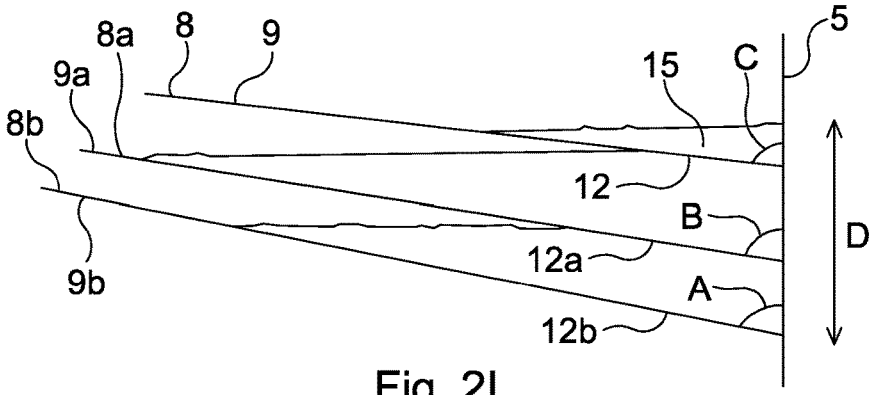
FIG. 2I illustrates a method of screening according to one or more embodiments disclosed and described herein.
Figure 2J:
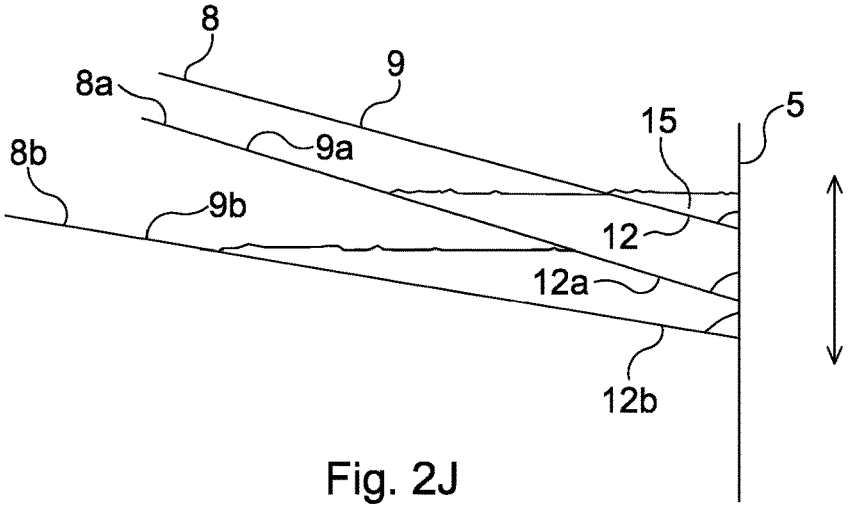
FIG. 2J illustrates a method of screening according to one or more embodiments disclosed and described herein.

FIGS. 2H to 2J illustrate various situations where screening surfaces are at different angles and/or at different spacings. In all these examples a composite pool is made but similar arrangements can be made with the mesh sizes of screening surfaces 9*a*, 9*b* and 9*c* chosen to give a common pool. FIG. 2H shows an arrangement where lower screening surfaces 9*a*, 9*b* are parallel and at an angle A with respect to fluid retaining wall 5. Upper screening surface 9 is at a shallower angle B leading to convergence of the solids discharge ends 8, 8*a*. In FIG. 2I all three angles A, B and C of the respective screening surfaces 9, 9*a*, 9*b* to the fluid retaining wall are different so that all the solids discharge ends 8, 8*a*, 8*b* tend to converge. In FIG. 2J the lower screening surface 9*b* is at a shallower angle than 9*a* and so discharge ends 8*a* and 8*b* diverge. As also illustrated in FIGS. 2H to 2J the spacings between feed receiving ends 12, 12*a* and 12*b* of surfaces 9, 9*a* and 9*b* can be varied. For example in FIG. 2J ends 12*a* and 12*b* are closer together than ends 12 and 12*a*.

Figure 2K:
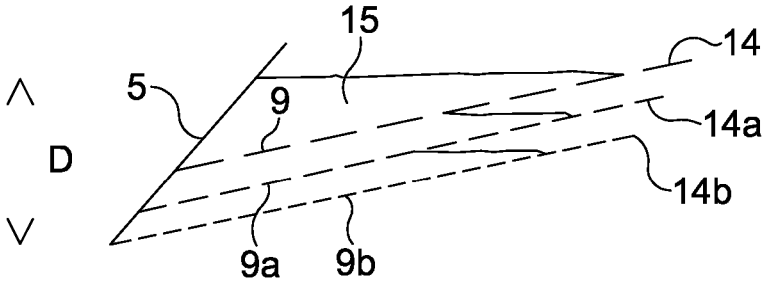
FIG. 2K illustrates a method of screening according to one or more embodiments disclosed and described herein.
Figure 2L:
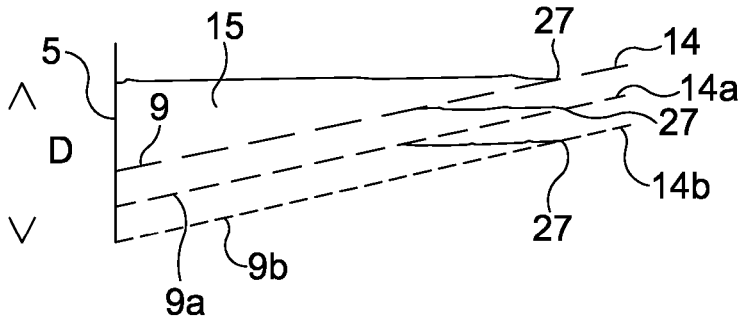
FIG. 2L illustrates a method of screening according to one or more embodiments disclosed and described herein.
Figure 2M:
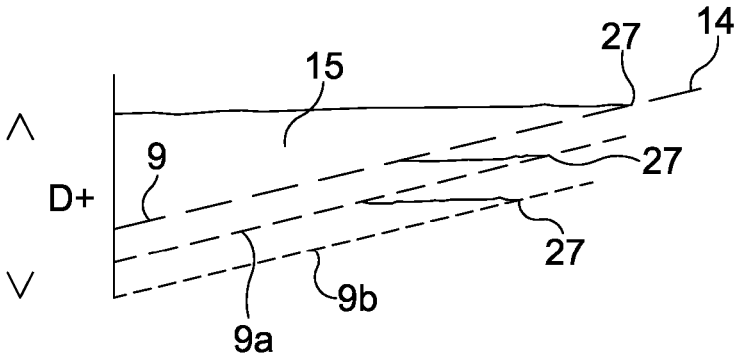
FIG. 2M illustrates a method of screening according to one or more embodiments disclosed and described herein.

FIGS. 2K, 2L and 2M illustrate the formation of composite pools with various screening surface arrangements. In FIG. 2K the fluid retaining wall 5 slopes downwardly in the direction away from the solids discharge ends 14, 14*a*, 14*b* of the screening surfaces 9, 9*a*, 9*b*. All three screening surfaces are of the same length. therefore the solids discharge end 14 of the uppermost surface 9 projects further than the solids discharge end 14*a* of the middle surface 9*a*. In turn the solids discharge end 14*a* of the middle surface 9*a* projects further than the solids discharge end 14*b* of the lower surface 9*b*. This arrangement avoids solids falling from the respective solids discharge ends 14, 14*a*, 14*b* interfering with each other as they fall. This allows separate collection of the solids form each screening surface if desired.

In FIG. 2L fluid retaining surface 5 is substantially vertical and all three screening surfaces are spaced apart and parallel. A composite pool is formed on the three screening surfaces. The start of beach 27 formed is at approximately the same distance from fluid retaining wall for all three screening surfaces 9, 9*a* and 9*b*. The possible depth D at the feed receiving end of the screening surfaces is limited by the length of the screening surfaces. Increasing depth D could cause fluid from the pond 15 to overflow at discharge end 14. FIG. 2M shows an arrangement similar to that of FIG. 2L, using the same choice of mesh sizes for each screening surface 9, 9*a* and 9*b*. The same spacing apart and angles from the horizontal are used for the screening surfaces. However the uppermost screening surface 9 is longer than middle surface 9*a* which in turn is longer than lowest surface 9*b*. This allows a longer flooded region on the uppermost screening surface (portion of screening surface in the pond 15) whilst maintaining the start of beach 27 at the same distance from the extreme end of the solids discharge end 14 as in FIG. 2M. The result of this is an enhanced depth D, shown as D+ on the drawing. Thus, providing an upper screening surface that is longer than a screening surface below allows a greater depth D+ when operating a composite pool system. This can improve throughput of fluid as a consequence of increased head pressure provided by D+. At the same time this arrangement allows the solids discharge ends 14, 14*a*, 14*b* of the screening surfaces to be staggered in extent to allow solids collection from each screen to be done separately if desired.

Figure 3:
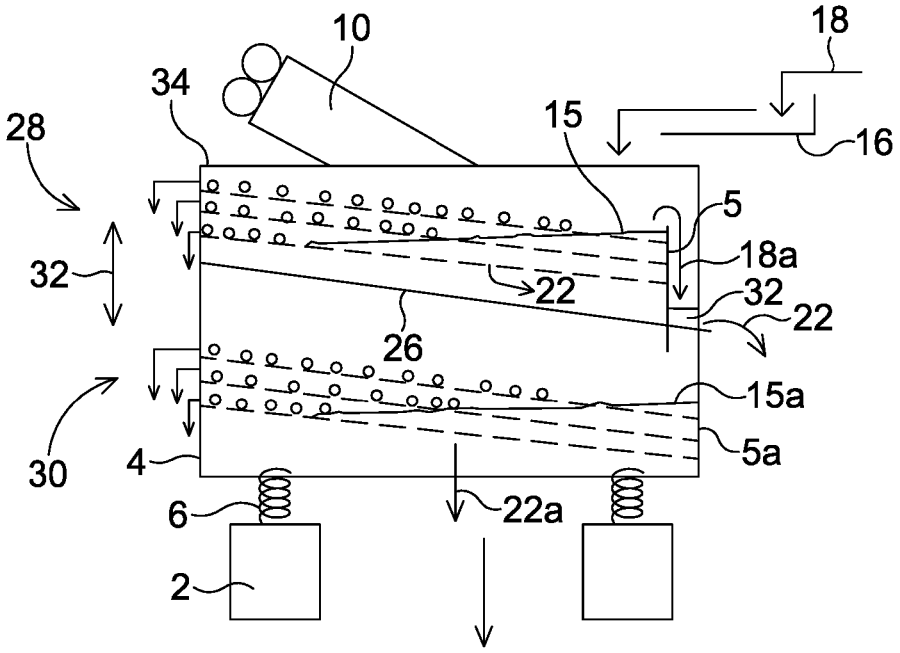
FIG. 3 illustrates a screening method and apparatus.

FIG. 3 shows a shale shaker 1 of similar type to that of FIG. 1 but fitted with two three deck arrangements such as shown in FIGS. 2A, 2B, numbered as 28, 30. The uppermost stack of three screen decks 28 receives the feed 18 and processes it as described above with respect to FIG. 2A. However, in this example fluid retaining wall 5 is in the form of a weir over which excess feed 18*a* flows down to the lower stack of three screen decks 30. This stack of three screen decks has its own pond, formed with fluid retaining wall 5*a* (the end wall of basket 4 in this example). More generally weirs may be used with any apparatus of one or more embodiments disclosed and described herein described herein to allow overflow of fluid. For example a weir may be provided at the feed receiving end of at least one, a plurality or even all of the screen decks of the shale shakers described herein, to aid in controlling the depth of fluid forming on the screening surface or surfaces.

Thus both stacks of three screen decks 28, 30 can operate in parallel carrying out the method of one or more embodiments disclosed and described herein, if sufficient flow of feed 18 to maintain both ponds 15 and 15*a* is provided. Filtrate 22 from the uppermost stack 28 is kept away from the lower stack 30 by means of a fluid directing tray 26 which directs the filtrate 22 out of the machine via one or more conduits 32 passing through walls 5,5*a*. The filtrate 22*a* from lower stack 30 exits from the bottom of basket 4.

As suggested by arrow 32 a jacking mechanism may be provided to raise and lower the solids discharge end 34 of the basket 4 slightly to allow adjustment of the slope of the screen decks to adjust the processing conditions.

Figure 4A:
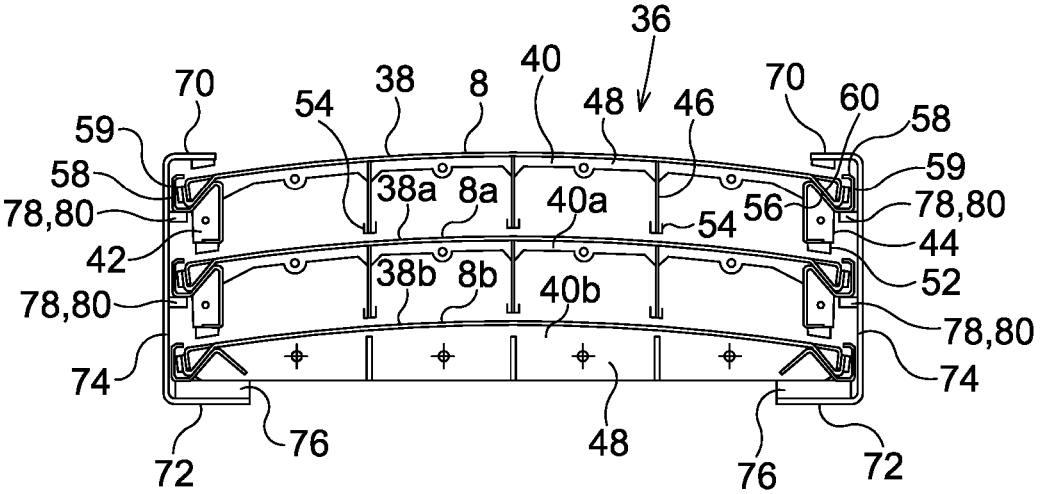
FIG. 4A illustrates aspects of screening apparatus according to one or more embodiments disclosed and described herein.

FIG. 4A shows in schematic cross section a stack of three screen decks 8, 8*a*, 8*b* in a screen system 36. The view is as looking from the discharge end of the stack of screen decks. Each screen deck has a screening surface 9, 9*a*, 9*b* of screen panels 38, 38*a*, 38*b*. The screen panels are of pre-tensioned wire mesh on an apertured plate (see FIG. 4D). The screen panels are supported on a respective support frame 40, 40*a*, 40*b*. In general for apparatus according to one or more embodiments disclosed and described herein screen frames can be connected with flexible non ridged fixings such that they 'bend' along their length to take up variances in straightness and different screen thicknesses. More than one screen frames can be used on a given screen deck and they can be connected together for convenience, for example with semi flexible connections between one and the next, to form the screen deck.

Figure 4B:
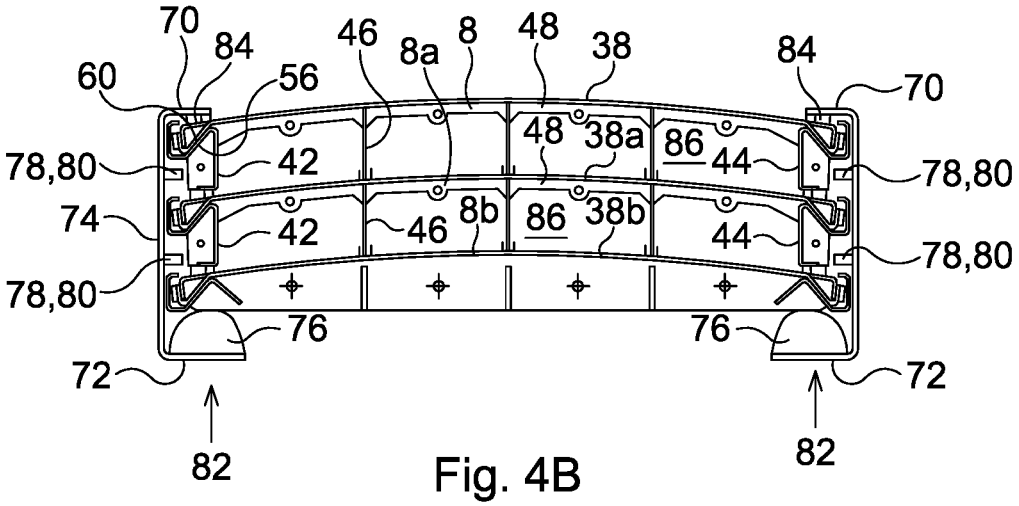
FIG. 4B illustrates aspects of a screening apparatus according to one or more embodiments disclosed and described herein.
Figure 4C:
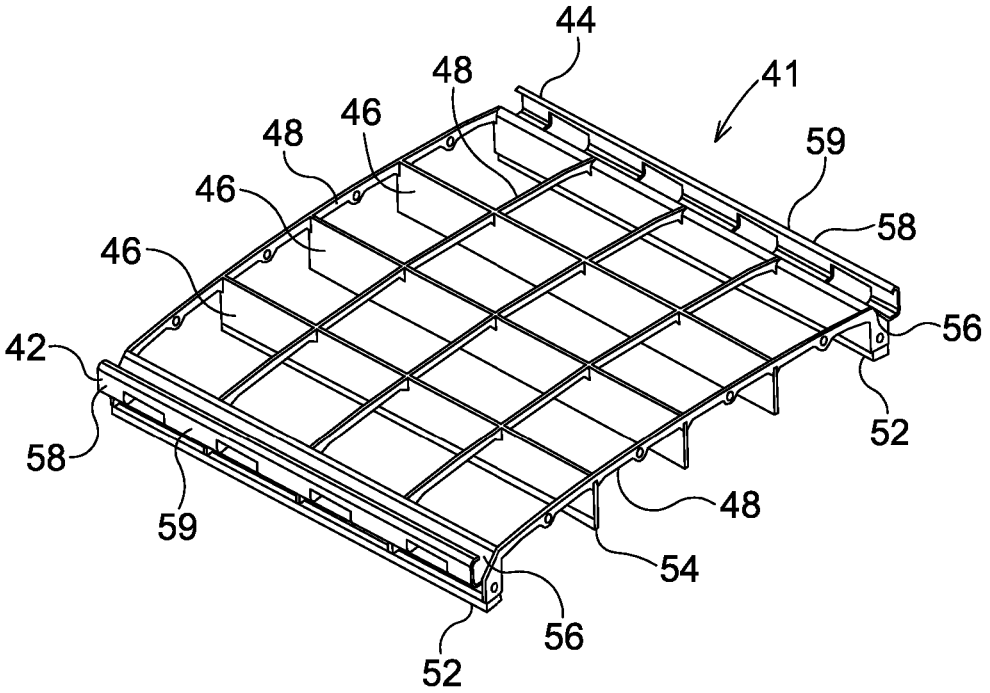
FIG. 4C illustrates aspects of a screening apparatus according to one or more embodiments disclosed and described herein.

As can be more easily seen in perspective view FIG. 4C of a support frame unit 41, the support frames 40, 40*a* of the two uppermost screen decks 8, 8*a* each comprise spaced apart first and second elongate support frame members 42, 44, further spaced apart additional elongate support frame members 46 in between (that run in the same direction); and cross members 48. These provide a frame with an arcuate, "crown deck" shape. As shown in FIG. 4C cross members 48 at the edges of the frame 40, 40*a* have bores 50 so that one or more of frame units 41 may be fastened together end to end (by bolts for example) to form a longer frame 40, 40*a* of a size to provide support for the screening surface required in a shaker.

The spaced apart first and second elongate support frame members 42, 44 are generally downwards directed towards the screening surface of the screen deck below as shown in FIG. 4A. They include sealing strips 52 of a resilient material such as a rubber running along the bottom edge, for engagement with a screening surface below as discussed with respect to FIG. 4B hereafter. Sealing strips 54 are also provided along the bottom edges of additional elongate support frame members 46 (only one shown in FIG. 4C).

The first and second elongate support frame members 42, 44 also include inclined top faces 56 and outwardly and upwardly extending webs 58 that turn back inwardly at their upper edges to form a retaining flange 59. These inclined faces accept similarly inclined underside faces 60 of screen panel support members 62 (FIG. 4D) and the flanges 59 retain the screen panel support members 62 when a screen panel 38, 38*a* is slid into position on top of its support frame 40, 40*a*.

The screen panel support members 62 include small discs or wheels 64 along their outer edges to facilitate insertion into the retaining flanges 59.

The lowermost support frame 40*b* of the screen system (FIG. 4E) is a more conventional form of support frame comprising support frame units 41. Two are shown in the figure, bolted 66 together end to end to form a frame. Frame 40*b* includes first and second elongate support frame members 42, 44 formed so that identical screen panels 38*b* may be used on the lowermost deck 8*b* to those as are used on the other two decks. Additional elongate support frame members 46 and cross members 48 provide an arcuate, "crown deck" shape. For the lowermost frame 40*b* the cross members are deeper for added strength and include small part circular cut outs 68 to accept rods of a resilient material such as a rubber to aid secure clamping and reduce wear when vibrating. Similar rods may be employed in the support frames 40, 40*a* (not shown).

The stack of three screen decks 8, 8*a*, 8*b* in the screen system 36 shown in FIG. 4A is retained between upper and lower screen clamping rails 70, 72 formed as inwardly projecting edges of generally U shaped, in cross section, elongate members 74. The bottom of the U is welded or otherwise fastened to a vertical or substantially vertical wall of the basket of a shale shaker (not shown see FIG. 6). These arrangements fix the relationship between the upper 70 and lower 72 rails, forming a channel between the arms of the U for clamping the screen decks in place.

FIG. 4A shows the unclamped condition where each screen deck is vertically spaced apart from the next in the stack and sitting on its respective rest. The lowermost screen deck 8*b* sits on deflated inflatable bladders 76 on the lower screen clamping rails 72. The retaining flanges 59 of the support frames 40, 40*a* of the uppermost two decks 8, 8*a* sit on rests 78 comprising a row of pins 80 (see FIG. 6) projecting inwards from the U shaped members 74. In this position the screen panels and/or the support frames of a screen deck may be withdrawn easily without interfering with the panels or frames of one of the other decks.

To clamp the stack of screen decks 8, 8*a*, 8*b* together for use in a screening operation the inflatable bladders are inflated (gas or liquid as inflation fluid) as shown in FIG. 4B. The upwards directed arrows 82 indicate the direction of travel of the stack of screen decks into the clamped position. In this position the stack of screen decks is firmly clamped between the upper and lower screen clamping rails 70, 72 and at the same time the screen panels 38, 38*a* and 38*b* are firmly clamped each to its corresponding support frame 40, 40*a*, 40*b*.

The screen panels are also tensioned across the support frames by the clamping action as the inclined underside faces 60 of screen panel support members 62 tend to slide down and outwards on the inclined top faces 56 of the first and second elongate support frame members 42, 44. Other tensioning approaches may be employed, for example a cam formation on screen panel support members 62 may be activated when squeezed between the screen clamping rails 70, 72 to rotate outwardly causing tensioning across the respective support frame.

Sealing and clamping is aided by sealing strips 84 along the underside of upper screen clamping rails 70.

In the clamped position of FIG. 4B the rests 78 for the uppermost two screen decks 8, 8*a* are not in use. The first and second elongate support frame members 42, 44 of the uppermost two support frames 40, 40*a* and their sealing strips 52 act to prevent liquid and solids being processed escaping laterally from screen decks 8*a*, 8*b*.

The cross members 48 of frames 40, 40*a* are of sufficiently narrow form and are attached at the top of first and second elongate support frame members 42, 44 and further spaced apart additional elongate support frame members 46. This provides spaces, (channels 86) to allow the transport of solids up and off the end of the screen decks as shown in FIG. 2A.

Figure 4D:
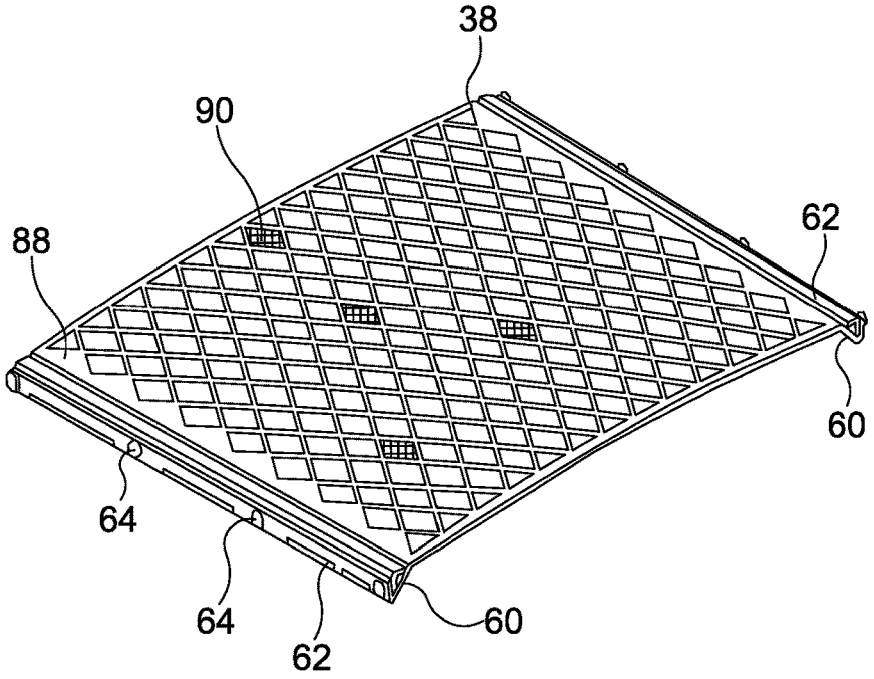
FIG. 4D illustrates aspects of a screening apparatus according to one or more embodiments disclosed and described herein.

FIG. 4D shows a representative screen panel 38 in the form of an apertured plate 88 between spaced apart screen panel support members 62 and covered by one or more layers of a pre-tensioned mesh 90. The mesh 90 covers the surface of the panel in the usual way, only partial hatching is shown in the figure to allow viewing of the apertured plate 88.

Figure 4E:
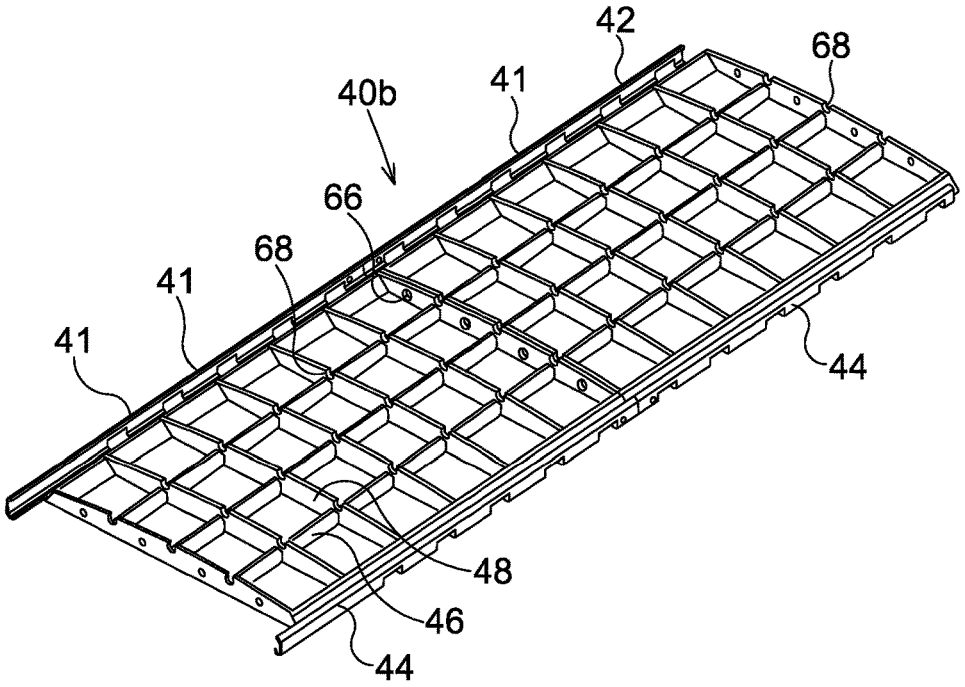
FIG. 4E illustrates aspects of a screening apparatus according to one or more embodiments disclosed and described herein.

FIG. 4E shows frame units 41 for the lowermost support frame 40*b*.

Figure 4F:
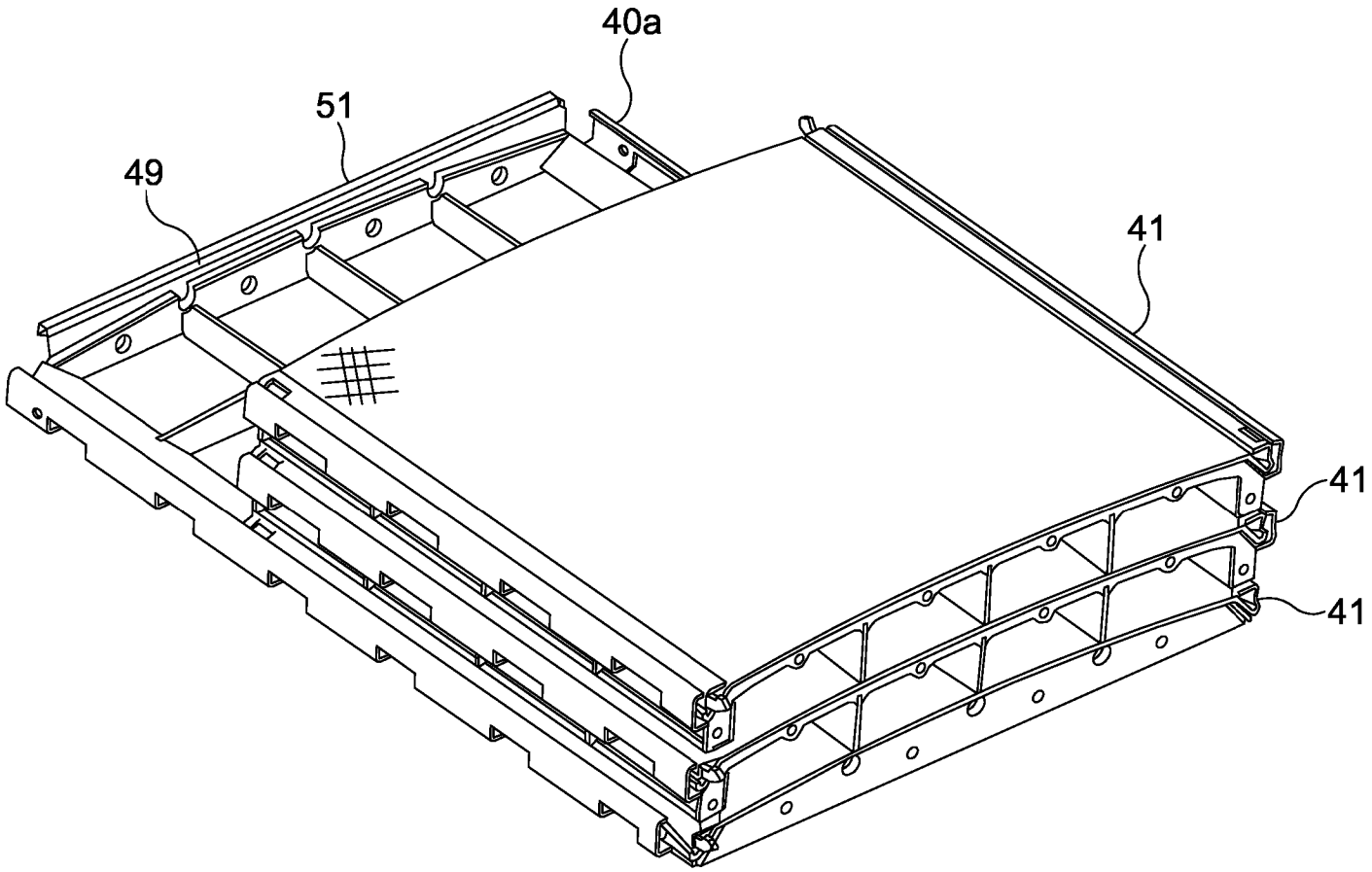
FIG. 4F illustrates aspects of a screening apparatus according to one or more embodiments disclosed and described herein.

FIG. 4F shows in schematic partial perspective a stack of three screen units 41 similar to those shown in the other FIG. 4 at the end of the lower most support frame 40*a* a sealing member 49 having a sealing strip 51 on its top edge is fitted to provide sealing to similar members fitted to the end of frames above when the clamping system is engaged. The sealing member and sealing strip of the uppermost screen deck engages with an upper sealing ledge of the fluid retaining wall of a basket (see FIG. 6A part 102) to complete sealing at fluid retaining wall 5.

Figure 5:
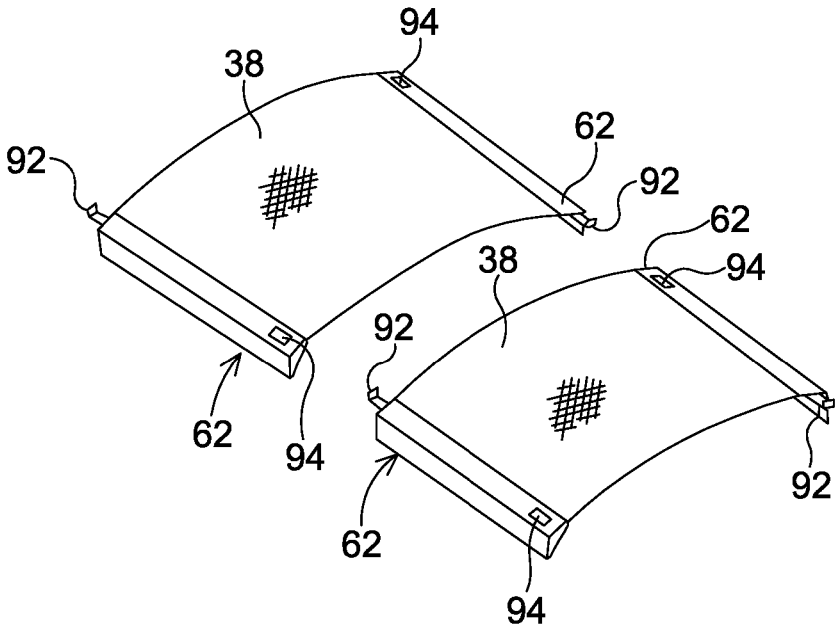
FIG. 5 shows screen panels.

FIG. 5 shows schematically two screen panels of the same general form of that of FIG. 4D but including hook 92 and aperture 94 formations to allow two or more screen panels to be linked together to form a screening surface.

Figure 6A:
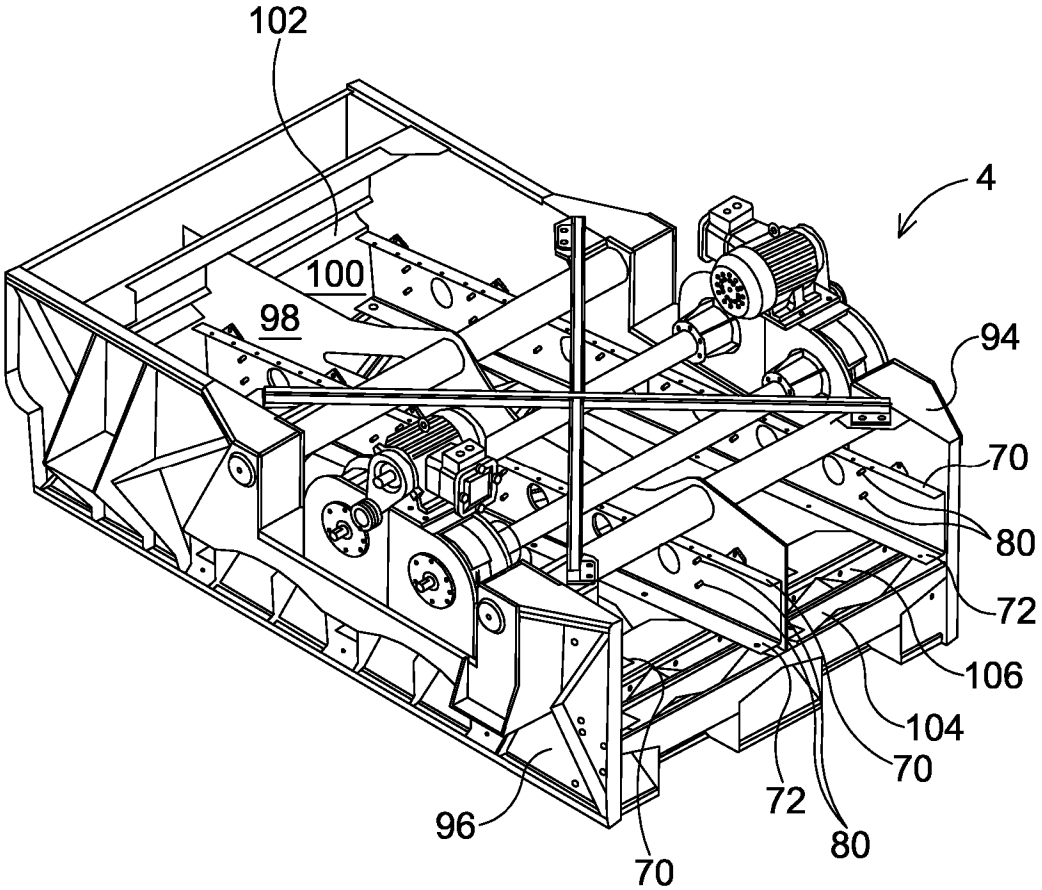
FIG. 6A illustrates a screening apparatus and methods according to one or more embodiments disclosed and described herein.

FIG. 6A shows in schematic perspective a shale shaker basket 4 fitted with upper and lower screen system clamping rails 70, 72 to either side wall 94, 96 and to both sides of divider wall 98. Two stacks of screen decks shown in FIG. 4 can be fitted into the machine to provide two side by side three deck modules. Rows of pins 80 are provided as rests 80 for support frames of screen decks. At the feed receiving end 100 of the basket 4 an upper sealing ledge 102 is provided. Also visible is a set of solids receiving troughs 104, 106 for directing solids discharging from screen decks to selected locations such as returning them to the screened fluid or to a tank or hopper for disposal or further processing.

Figure 6B:
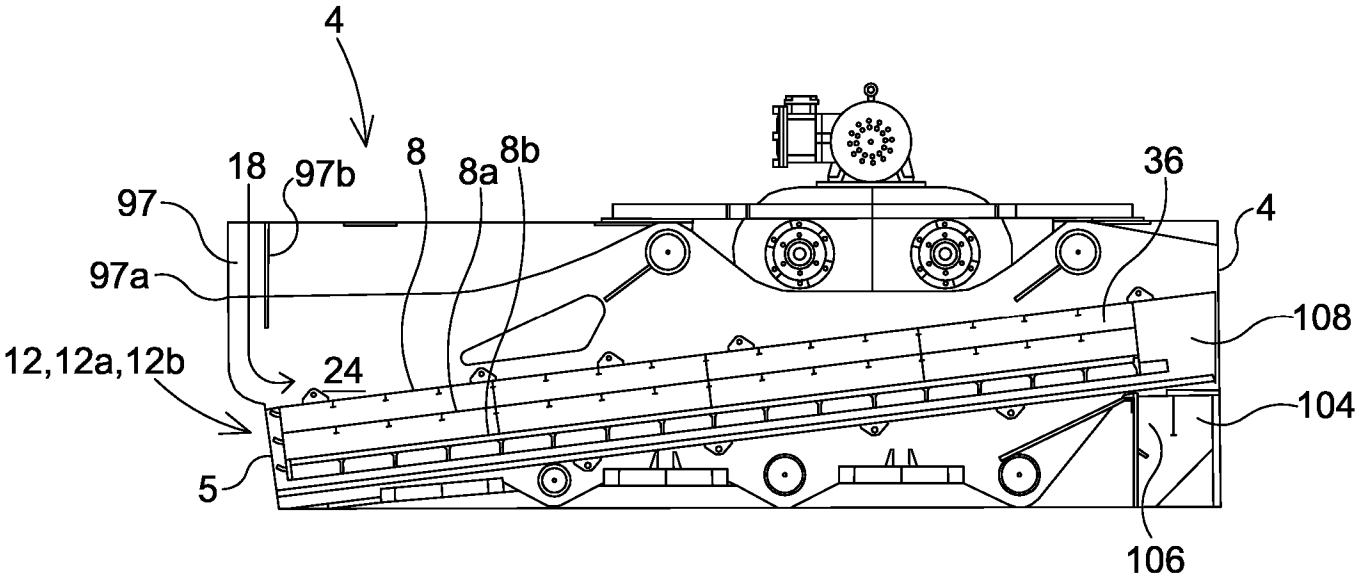
FIG. 6B illustrates a screening apparatus and methods according to one or more embodiments disclosed and described herein.

Shown in FIG. 6B is a schematic side elevation cross section showing the shaker basket 4 fitted with screen system 36, inclined to have feed receiving ends 12, 12*a*, 12*b* for the screen decks 8, 8*a*, 8*b* at the inclined fluid retaining wall 5 at an end of the basket 4. The fluid retaining wall 5 is at right angles to the slope of the screening surfaces as they run up to the solids discharge end. (Two three deck arrangements would be fitted, one to each side of the basket 4). The feed to the feed receiving ends 12, 12*a*, 12*b* is via a conduit 97 that directs the feed 18 downwards and then substantially horizontally onto the pond region 24.

The solids discharge ends of the screen decks 8, 8*a*, 8*b* shown in FIG. 6B end together in close to vertical alignment. To allow choice as to the direction of solids discharged from a given deck a screen deck extension module (see FIG. 7) may be fitted in space 108 which is above the solids receiving troughs 104, 106

In this example the screen decks 8, 8*a*, 8*b* each comprise four frame units 41 and four screen panels 38, to provide a relatively long screening surface to each deck.

Figure 6C:
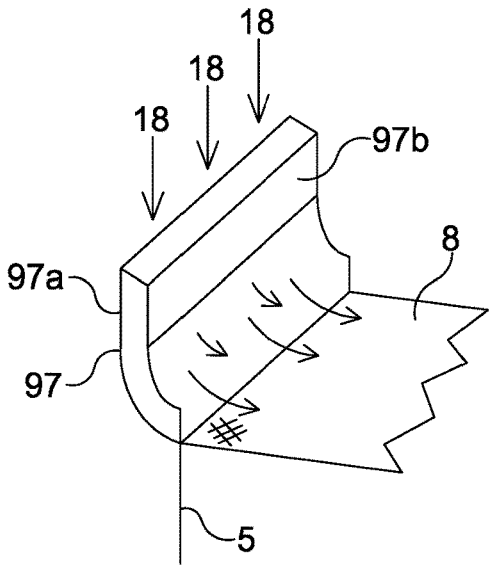
FIG. 6C illustrates a screening apparatus and methods according to one or more embodiments disclosed and described herein.
Figure 6D:
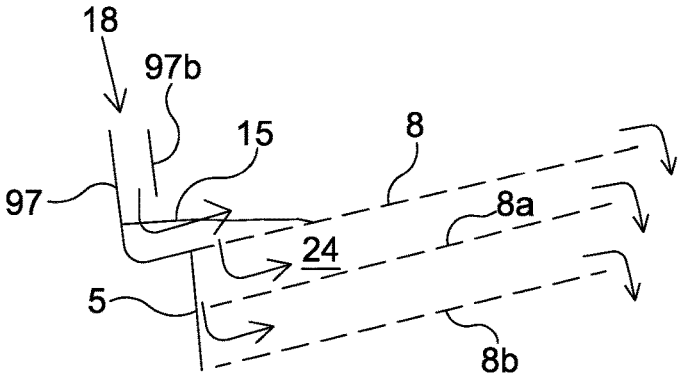
FIG. 6D illustrates a screening apparatus and methods according to one or more embodiments disclosed and described herein.
Figure 6E:
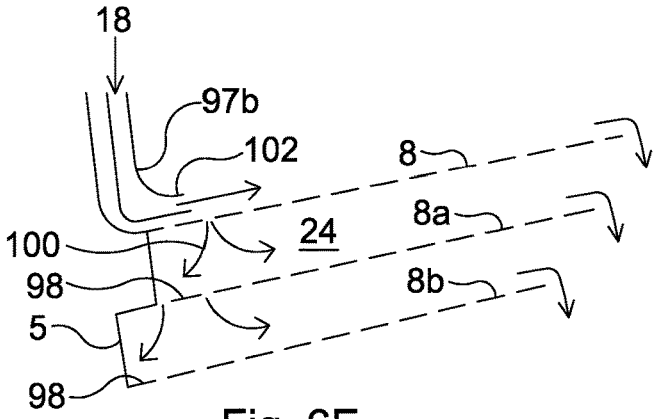
FIG. 6E illustrates a screening apparatus and methods according to one or more embodiments disclosed and described herein.

The feed arrangement is shown schematically in FIG. 6C. The bottom end of conduit 96 delivers the feed 18 across the width of the screening surface of the uppermost screen deck 8. As seen in FIG. 6B the delivery of the feed 18 is in advance of the fluid retaining wall 5. This feed delivery, in alignment with the slope of the screening surface of screen deck 8, before the fluid retaining wall begins, can be seen more clearly in side elevation 6D. The conduit 97 has a back face 97*a* that turns to direct fluid forwards onto screen deck 8 and a front face 97*b*. Advantageously front face 97*a* is not immersed in a pond 15 forming on screen deck 8 (as indicated as an example in FIG. 6D). It has been observed that immersing the front face 97*b* of a conduit in the fluid, when directing the flow in alignment with the slope of the screening surface of screen deck 8 can induce turbulence. FIG. 6E shows a delivery of feed where the feed 18 is delivered by the conduit 97 onto the screen deck 8 after the fluid retaining wall 5 resulting in some "dead" space 98 between decks 8 and 8*a* where the feed will tend to be more turbulent as it flows back as indicated by arrow 100 to fill the pond region. In FIG. 6E the fluid retaining wall 5 at the space between decks 8*a* and 8*b* is even more horizontally displaced from the delivery end 102 of the feed conduit, resulting in further turbulence in the pond region.

Figure 6F:
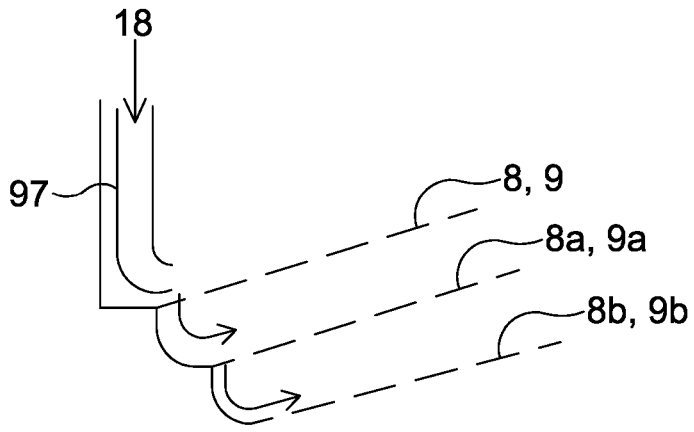
FIG. 6F illustrates a screening apparatus and methods according to one or more embodiments disclosed and described herein.

In FIG. 6F a stepped fluid retaining wall 5 is shown with each lower screen deck 8,8*a*,8*b* having the feed receiving end of each successively lower screen deck located closer to the solids receiving end of the basket than the feed receiving end of the screen deck above.

Figure 6G:
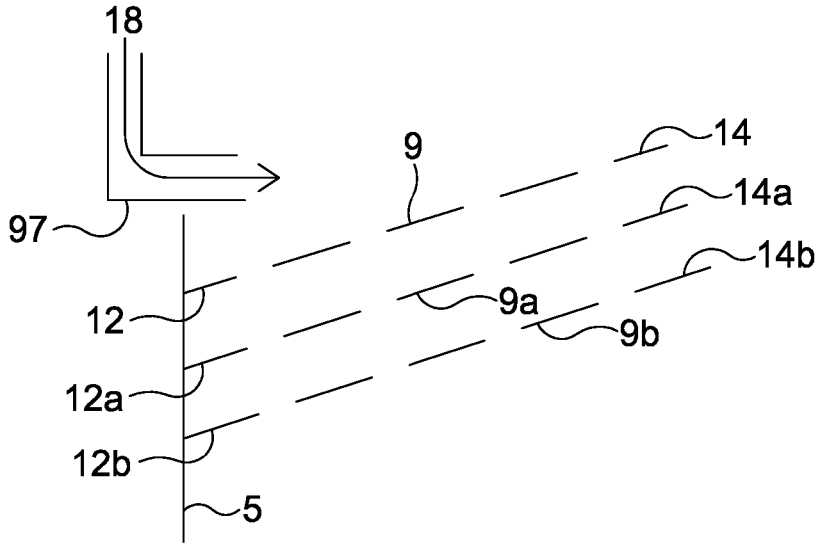
FIG. 6G illustrates a screening apparatus and methods according to one or more embodiments disclosed and described herein.
Figure 7C:
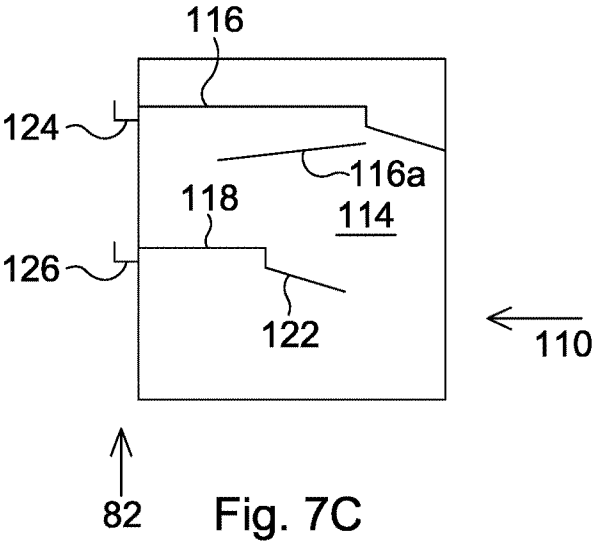
FIG. 7C illustrates a screen deck extension module according to one or more embodiments disclosed and described herein.
Figure 7B:
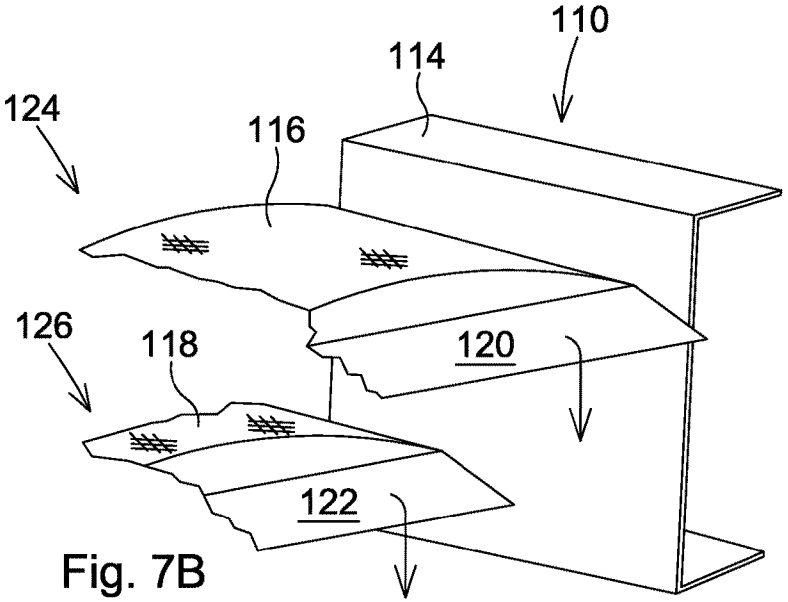
FIG. 7B illustrates a screen deck extension module according to one or more embodiments disclosed and described herein.
Figure 7A:
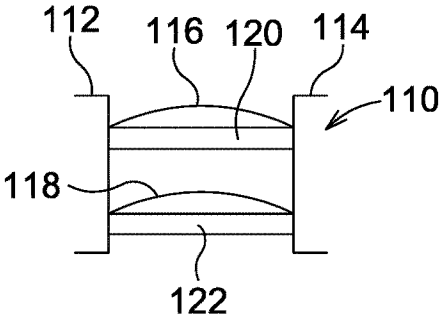
FIG. 7A illustrates a screen deck extension module according to one or more embodiments disclosed and described herein.
Figure 7D:
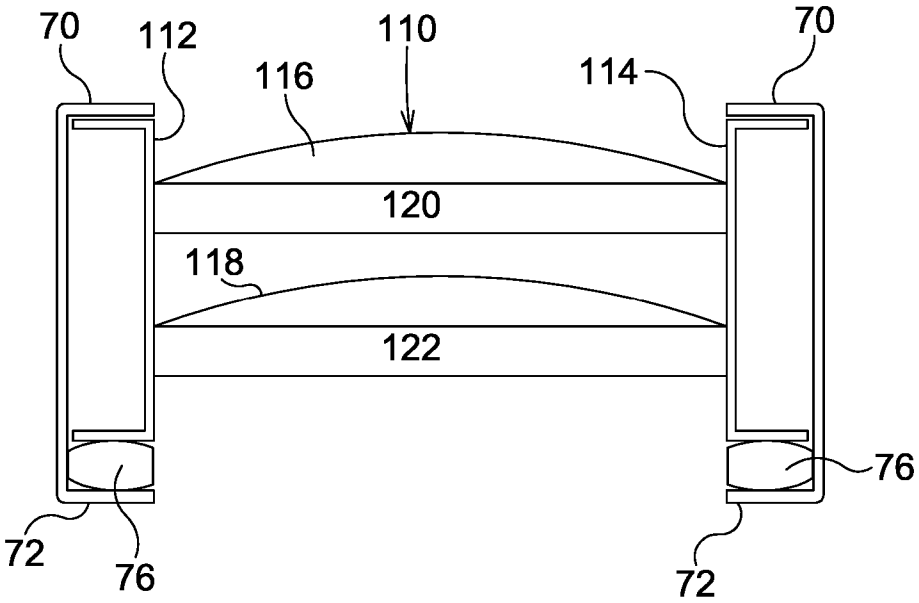
FIG. 7D illustrates a screen deck extension module according to one or more embodiments disclosed and described herein.

In FIG. 6G the bottom end of conduit 97 delivers the feed 18 substantially horizontally (generally in alignment with the screening surfaces 9,9*a*,9*b*, whose slope is exaggerated in the schematic drawing, for clarity) and in the direction of the solids discharge ends 14, 14*a*, 14*b* of the screening surfaces. This arrangement has been found advantageous in promoting good efficient throughput. Other arrangements are possible. The conduit 97 as shown does not contact the basket and is sited sufficiently high above the uppermost screening surface 9 so as to not contact a pond forming on that surface 9 in use. The conduit 97 does not contact the basket of the shale shaker it feeds. As an alternative the end of conduit 97 could be connected to the basket, at least sufficiently so as to be vibrated in use.

In FIG. 7 a screen deck extension module 110 is shown. In end elevation in FIG. 7A the structure has two support flanges 112, 114 supporting, in this example, two screening surface extensions 116, 118 of crown deck form and having sloping solids discharge plates 120, 122. The structure can be more easily seen in cut away perspective view FIG. 7B showing one flange 114 and parts of screening surfaces 116 and 118. The screening surfaces and discharge plates allow extension of the screen decks 8, 8*a*, depicted in FIG. 6 so that solids discharged from the upper two screen decks 8, 8*a* will be dropped vertically in different locations as desired. Solids discharged from the lowest screen deck will be discharged at the end of the unextended screen deck 8*b*. As shown in cross section FIG. 7C hook formations 124, 126 are provided in the screen extensions 116, 118 which when a clamping force 82 is applied will engage upwardly onto the ends of the support frames of the corresponding screen decks 8, 8*a*. Thus the module may be securely clamped in the basket using the same clamping system as employed for the screen decks (FIGS. 4A, 4B) See FIG. 7D depicting the end view of a fitted module. As extension 116 is longer than extension 118, a short flow directing tray 116*a* (shown only in FIG. 7C) may be fitted. It may be welded between flanges 112 and 114. This can direct any fluid passing through 116 away from the lower solids discharge plate 122.

FIGS. 8A to 8H illustrate schematically the use of fluid retaining surfaces to space the feed receiving end of screening surfaces away from the fluid retaining wall, to reduce screen wear and smooth solids transport.

Figure 8A:
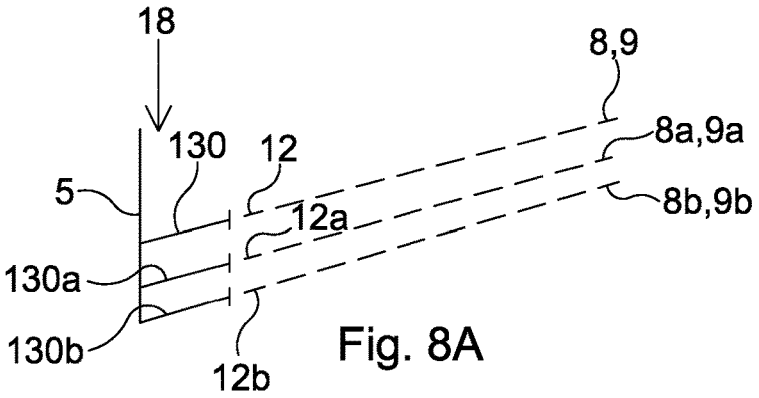
FIG. 8A illustrates aspects of a screening apparatus according to one or more embodiments disclosed and described herein.
Figure 8B:
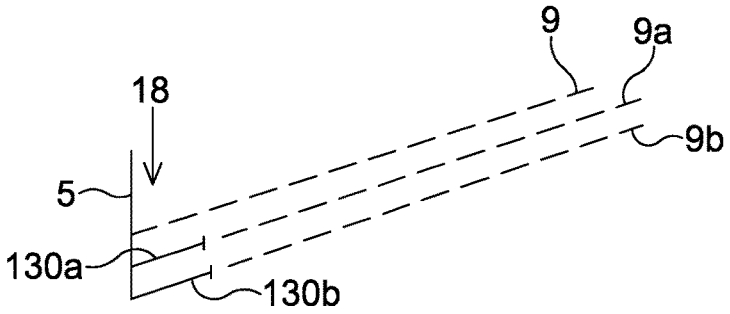
FIG. 8B illustrates aspects of a screening apparatus according to one or more embodiments disclosed and described herein.

In FIG. 8A the fluid retaining wall 5 of a basket is shown schematically with three screen decks 8, 8*a*, 8*b* having screening surfaces 9, 9*a*, 9*b* depicted in a similar fashion to the illustrations of FIG. 2. Feed is applied as indicated by arrow 18. In FIG. 8A all three screening surfaces 9, 9*a*, 9*b* are spaced away from fluid retaining wall 5 by equal length fluid retaining surfaces 130, 130*a* and 130*b*, that may be steel plates welded to the fluid retaining wall, extending between wall 5 and the feed receiving ends 12, 12*a*, 12*b* of the screening surfaces 9, 9*a*, 9*b*. The effect of plates 130, 130*a* and 130*b* is to reduce wear at the feed receiving ends 12, 12*a*, 12*b* of the screening surfaces 9, 9*a*, 9*b*. In this example the fluid retaining surfaces 130, 130*a* and 130*b* are provided at the same or substantially the same angle of inclination as the screening surfaces In FIG. 8B a similar arrangement to that of FIG. 8A is shown except that no fluid retaining surface 130 is fitted to the uppermost screening surface 9. Turbulence from the feed 18 tends to aid in avoiding a solids build up on the uppermost screening surface.

Figure 8C:
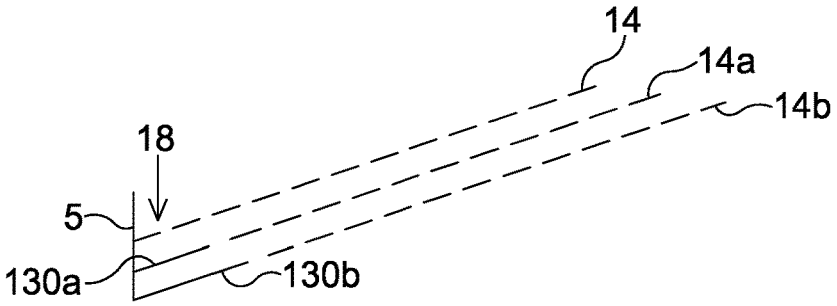
FIG. 8C illustrates aspects of a screening apparatus according to one or more embodiments disclosed and described herein.
Figure 8D:
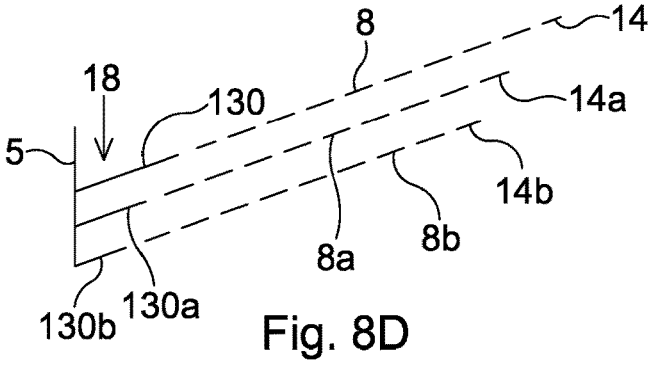
FIG. 8D illustrates aspects of a screening apparatus according to one or more embodiments disclosed and described herein.
Figure 8E:
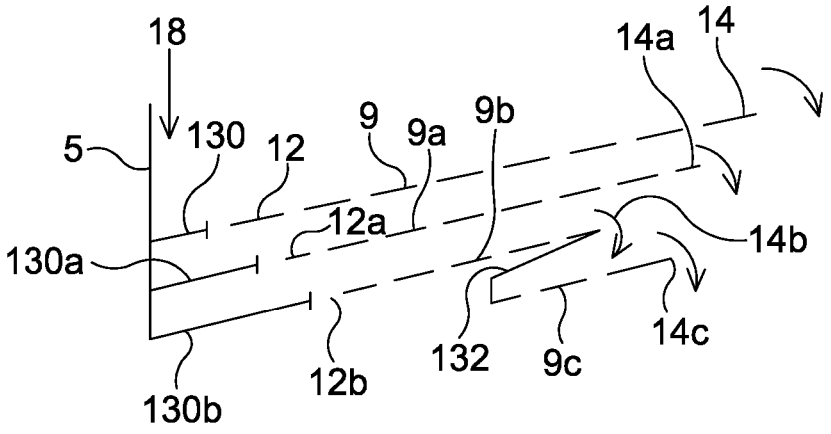
FIG. 8E illustrates aspects of a screening apparatus according to one or more embodiments disclosed and described herein.

In FIG. 8C no fluid retaining surface 130 is fitted to the uppermost screening surface 9 and plates 130*a* and 130*b* are of differing lengths with the lower surface 130*b* extending further than the upper surface 130*a*. The solids discharge ends 14, 14*a*, 14*b* extend to different extents as common length screening surfaces are employed in this example. Avoiding solids discharging from say screening surface 9 falling onto the screening surfaces below may be achieved by adding suitable screen extensions (akin to that depicted in FIG. 7A). Alternatively different length screening surfaces may be employed, for example differing numbers of screening panels to make up the screening surfaces or different sizes of screening panels. This can achieve an arrangement of solids discharge ends such as that shown in FIG. 2B. This arrangement of fluid retaining surfaces has been found particularly effective in reducing screen wear. FIG. 8E discussed below depicts a further way of employing fluid retaining surfaces In FIG. 8D a yet further arrangement is employed where all three screen decks 8, 8*a*, 8*b* have fluid retaining surfaces 130, 130*a* and 130*b* spacing them apart from the fluid retaining wall 5. In this example surfaces 130, 130*a* and 130*b* are of differing lengths, each fluid retaining surface provides a longer spacing between wall 5 and its respective screening surface than the fluid retaining surface for the screen deck above. This has the advantage of allowing solids discharge ends 14, 14*a*, 14*b* to extend in the manner shown with solids falling off each end not interfering with solids discharge operations from the screening surface below.

In FIG. 8E all three screen decks having screening surfaces 9, 9*a*, 9*b* are provided with a fluid retaining surface 130, 130*a*, 130*b*. Each surface (e.g. a steel plate) is longer than the one above, increasing the spacing of the feed receiving ends 12, 12*a*, 12*b* of the screening surfaces 9, 9*a*, 9*b* from the fluid retaining wall 5. To avoid the configuration of solids discharge ends 14, 14*a*, 14*b* depicted in FIG. 8C different lengths of screening surfaces are employed. For example uppermost screening surface 9 may employ four "extended length" screen panels laid end to end. Middle screening surface 9*a* may employ four standard length (shorter than used for surface 9) screen panels laid end to end. Lower screening surface 9*b* may employ three standard screen panels. This can provide the staggering of the solids discharge ends 14, 14*a*, 14*b* depicted, allowing solids to fall without interfering with the discharge operation of the screening surface below. In this example as the lower screening surface 9*b* only has three screen panels in length, dewatering of solids transported off that screen deck may be less than ideal. This issue is mitigated by providing an additional screening surface 9*c* at, and below, the discharge end 14*b* of surface 9*b*. The additional screening surface discharges at end 14*c*. A flow directing tray 132 is placed between surfaces 9*b* and 9*c* to prevent filtrate from 9*b* falling onto 9*c*.

Figure 8F:
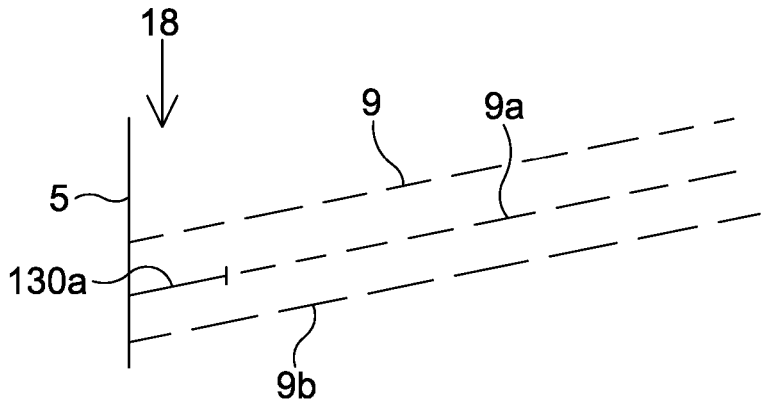
FIG. 8F illustrates aspects of a screening apparatus according to one or more embodiments disclosed and described herein.
Figure 8G:
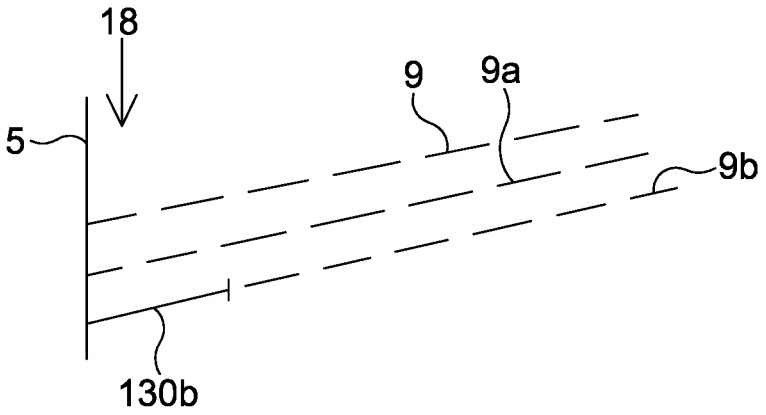
FIG. 8G illustrates aspects of a screening apparatus according to one or more embodiments disclosed and described herein.

FIGS. 8F and 8G show examples with only one fluid retaining surface fitted. In 8F fluid retaining surface 130*a* to the middle screening surface 9*a* and in FIG. 8G fluid retaining surface to the lowest screening surface 9*b*.

Figure 8H:
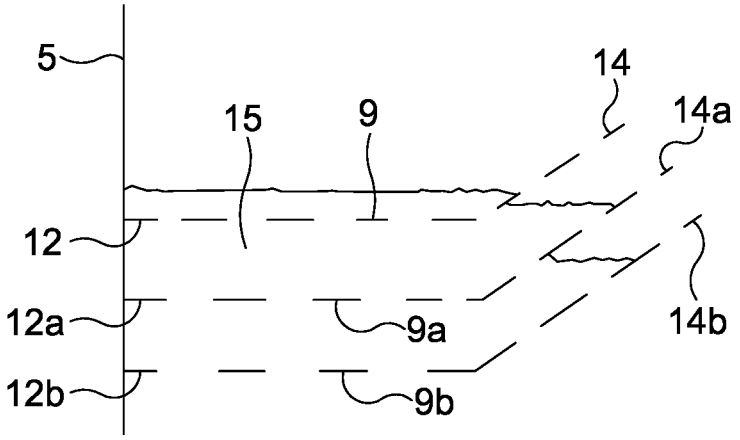
FIG. 8H illustrates aspects of a screening apparatus according to one or more embodiments disclosed and described herein.

FIG. 8H shows schematically an arrangement with a composite pool in the pond region 15, wherein the screening surfaces 9, 9*a* and 9*b* are substantially horizontal at the feed receiving ends 12, 12*a*, 12*b*. The screening surfaces 9, 9*a* and 9*b* incline upwards at the solids discharge ends 14, 14*a*, 14*b* to allow formation of pond 15.

The invention claimed is:

1. A shale shaker comprising:

a basket including a stack of at least three screen decks, each deck having a screening surface, with the screening surface of each deck spaced apart and superposed one above the other to constitute upper, middle, and lowest screen decks, wherein:

the screening surfaces of each of the three screen decks have a lower, feed receiving, end that is proximal to a fluid retaining wall of the basket and a distal, higher, solids discharge end;

each of the three screen decks are spaced apart, one from the next in the stack of three, by a spacing of from 20 mm to 120 mm, at their feed receiving ends;

the fluid retaining wall and the feed receiving end of the screening surface of the lowest screen deck of the at least three screen decks defines a pond region;

the screening surfaces of the middle and lowest screen decks are in sealing engagement with the fluid retaining wall;

whereby the apparatus is configured so that a drill cuttings and drilling mud mixture feed applied to the feed receiving end of the at least three screen decks can form and maintain a pond of solids and liquid in the pond region that immerses a portion of the screening surface at the feed receiving end of at least the middle and lowest screen decks and allows full or substantially full successive screening in turn through the middle and lowest screen deck, of the portion of drill cuttings and drilling mud mixture feed that passes through the screening surface of the upper screen deck.

2. The shale shaker of claim 1 wherein the screening surfaces of the at least three screen decks are spaced apart, one from the next in the stack by a spacing of from 30 mm to 80 mm at their feed receiving ends.

3. The shale shaker of claim 1 wherein the screening surfaces of the at least three screen decks are spaced apart, one from the next in the stack by a spacing of from 40 mm to 60 mm at their feed receiving ends.

4. The shale shaker of claim 1 wherein the feed receiving end of the screening surface of at least one of the three screen decks is spaced away from the fluid retaining wall by a fluid retaining surface extending between the fluid retaining wall and the feed receiving end of a respective screening surface.

5. The shale shaker of claim 4 wherein the feed receiving end of the screening surface of at least one of the lowest two of the three screen decks is spaced away from the fluid retaining wall by a fluid retaining surface extending between the fluid retaining wall and the feed receiving end of a respective screening surface.

6. The shale shaker claim 5 wherein the feed receiving ends of the screening surfaces of the lowest two of the three screen decks are spaced away from the fluid retaining wall by a fluid retaining surface extending between the fluid retaining wall and the feed receiving end of a respective screening surface.

7. The shale shaker claim 5 wherein the feed receiving ends of the screening surfaces of all three of the three screen decks are spaced away from the fluid retaining wall by a fluid retaining surface extending between the fluid retaining wall and the feed receiving end of a respective screening surface.

8. The shale shaker of claim 1 wherein the screening surfaces of each of the three screen decks are inclined from the horizontal from the lower, feed receiving end, to higher, solids discharge end.

9. The shale shaker of claim 8 wherein at least one of the screening surfaces of the three screen decks is inclined from the horizontal at a different angle from that of the other two screen decks; or each of the screening surfaces of the respective three screen decks is inclined from the horizontal at a different angle from the horizontal from the other two.

10. The shale shaker of claim 8 wherein the screening surfaces of the at least three screen decks are spaced apart and parallel.

11. The shale shaker of claim 1 wherein a fourth screen deck is provided, the fourth screen deck having a screening surface spaced apart and superposed above the uppermost screening surface of the stack of at least three screen decks.

12. The shale shaker of claim 11 wherein the screening surface of the fourth screen deck is horizontal or substantially horizontal.

13. The shale shaker of claim 1 wherein an elliptical, linear or combination of elliptical and linear vibratory motion is provided to the basket by a vibratory drive mechanism or mechanisms.

14. The shale shaker of claim 13 wherein an elliptical, linear or combination of elliptical and linear vibratory motion is provided to the basket by a vibratory drive mechanism, with an angle of vibratory pattern at from 2 to 70 degrees from the horizontal.

15. The shale shaker of claim 13 wherein an elliptical, linear or combination of elliptical and linear vibratory motion is provided to the basket, by a vibratory drive mechanism, with an angle of vibratory pattern at from 8 to 55 degrees from the horizontal.

16. The shale shaker of claim 13 wherein an elliptical, linear or combination of elliptical and linear vibratory motion is provided to the basket by a vibratory drive mechanism, with an angle of vibratory pattern from the horizontal that is higher at the solids discharge end of the basket than at the feed receiving end of the basket.

17. The shale shaker of claim 16 wherein an elliptical, linear or combination of elliptical and linear vibratory motion is provided to the basket, with an angle of vibratory pattern of from 2 to 70 degrees from the horizontal at the solids discharge end of the basket.

18. The shale shaker of claim 1 wherein each of the screening surfaces of the at least three screen decks is in sealing engagement with the fluid retaining wall, optionally via a respective fluid retaining surface extending between the fluid retaining wall and the feed receiving end of the respective screening surface, so as to allow the full or substantially full successive screening of the drill cuttings and drilling mud mixture feed through each screen deck in turn.

19. The shale shaker of claim 4 wherein the fluid retaining surfaces are plates permanently fixed to the fluid retaining wall.

20. The shale shaker of claim 4 wherein the fluid retaining surfaces are provided as part of a screen panel or associated support frame.

21. The shale shaker of claim 4 wherein the fluid retaining surfaces are provided as separate items for location between a fluid retaining wall and screening surface when the screen decks are made up in the basket.

22. The shale shaker of claim 4 wherein the spacing provided between the fluid retaining wall and the beginning of each screening surface, where a fluid retaining surface is provided, is at least 60 mm.

23. The shale shaker of claim 22 wherein the spacing provided between the fluid retaining wall and the beginning of each screening surface, where a fluid retaining surface is provided, is from 60 mm to 500 mm.

24. The shale shaker of claim 4 wherein at least one of the fluid retaining surfaces extends between the fluid retaining wall and the feed receiving end of a respective screening surface at substantially the same inclination from the horizontal as the feed receiving end of the said screening surface or at a greater upwards inclination from the horizontal than the feed receiving end of the said screening surface.

25. The shale shaker of claim 4 wherein at least one of the fluid retaining surfaces extends between the fluid retaining wall and the feed receiving end of a respective screening surface at right angles from the fluid retaining wall.

26. The shale shaker of claim 4 wherein at least one of the fluid retaining surfaces extends between the fluid retaining wall and the feed receiving end of a respective screening surface at a downwards inclination from the fluid retaining wall.

27. The shale shaker of claim 4, wherein at least two screen decks are provided with fluid retaining surfaces and the extent of the spacing of the feed receiving ends of the screening surfaces away from the fluid retaining wall, provided by the fluid retaining surfaces, varies between at least two of the screen decks provided with fluid retaining surfaces.

28. The shale shaker of claim 4 wherein the fluid retaining surfaces provide the same spacing between the fluid retaining wall and the corresponding screening surface at each screen deck level.

29. The shale shaker of claim 5 wherein each fluid retaining surface provides a shorter spacing between the fluid retaining wall and screening surface than the screening surface for the screen deck above.

30. The shale shaker of claim 4 wherein each fluid retaining surface provides a longer spacing between the fluid retaining wall and screening surface than the screening surface for the screen deck above.

31. The shale shaker of claim 1 wherein a screen deck extension is provided at the solids discharge end of at least one of the screening surfaces.

32. The shale shaker of claim 30 wherein different numbers of screen panels and/or different lengths of screen panels are employed to make up the screening surfaces of each screen deck.

33. The shale shaker of claim 1 wherein a further screening surface is provided at and below the solids discharge end of the lowest screen deck of the stack of at least three screen decks.

34. The shale shaker of claim 1 wherein flow directing trays are not provided between the at least three screen decks.

35. The shale shaker of claim 1 wherein flow directing trays are not provided between the at least three screen decks, in the region where a pond of fluid collects in use of the shale shaker.

36. The shale shaker of claim 1 wherein the fluid retaining wall is vertical or substantially vertical in use.

37. The shale shaker of claim 1 wherein the fluid retaining wall is at right angles to the feed receiving ends of the screen surfaces.

38. The shale shaker of claim 1 wherein the fluid retaining wall slopes downwardly in the direction towards the solids discharge end of the screening surfaces.

39. The shale shaker of claim 1 wherein the fluid retaining wall slopes downwardly in the direction away from the solids discharge end of the screening surfaces.

40. The shale shaker of claim 1 further comprising a jacking mechanism operable to adjust the angle of the basket relative to the horizontal.

41. The shale shaker of claim 1 further comprising a feed conduit for supplying a drill cuttings and drilling mud mixture feed at the feed receiving end of the screening surfaces, wherein the feed is supplied from the conduit in a horizontal or substantially horizontal flow in the direction of the solids discharge end of the screening surfaces.

42. The shale shaker of claim 41 wherein the feed conduit is formed and arranged so that it is not immersed in the fluid forming a pond in the basket and either:

the said feed conduit is not connected to the basket; or at least the feed discharge end of the conduit is connected to the basket.

43. The shale shaker of claim 41 wherein the feed conduit has a back face shaped to direct the fluid flow in the direction of the solids discharge end of the screening surfaces and a front face nearer the screening surfaces; wherein the front face is not immersed in the fluid forming a pond in the basket, in use of the shale shaker.

44. The shale shaker of claim 1 wherein:

the solids discharge end of the screening surface of the uppermost deck extends further away from the feed receiving end of the basket than the solids discharge end of the screening surface of the middle deck; and the solids discharge end of the screening surface of the middle deck extends further away from the feed receiving end of the basket than the solids discharge end of the screening surface of the lowermost deck;

of the stack of three decks.

45. A method for separating solids from a drill cuttings and drilling mud mixture feed, the method comprising:

a) providing a shale shaker having a basket including a stack of at least two screen decks, each deck having a screening surface, wherein the screening surfaces of the decks are spaced apart and superposed one above the other; and wherein:

the screening surfaces of each of the two screen decks have a lower, feed receiving, end that is proximal to a fluid retaining wall, and a distal, higher, solids discharge end;

wherein the fluid retaining wall and the feed receiving end of the screening surface of the lowest screen deck of the at least two screen decks define a pond region;

b) providing a drill cuttings and drilling mud mixture feed to the feed receiving end of the at least two screen decks so as to form a pond of solids and liquid in the pond region that immerses a portion of the screening surface at the feed receiving end of each of the two screen decks; and c) operating the shale shaker with a feed rate so as to maintain the pond whilst screening the drill cuttings and drilling mud mixture feed on the screening surfaces.

46. The method of claim 45 wherein a stack of at least three screen decks is provided and each deck has a screening surface, wherein the screening surfaces of the decks are spaced apart and superposed one above the other; and wherein:

the screening surfaces of each of the three screen decks have a lower, feed receiving, end that is proximal to a fluid retaining wall, and a distal, higher, solids discharge end;

wherein the fluid retaining wall and the feed receiving end of the screening surface of the lowest screen deck of the at least three screen decks define a pond region;

b) providing a drill cuttings and drilling mud mixture feed to the feed receiving end of the at least three screen decks so as to form a pond of solids and liquid in the pond region that immerses a portion of the screening surface at the feed receiving end of at least the lowest and next to lowest screen decks; and c) operating the shale shaker with a feed rate so as to maintain the pond whilst screening the drill cuttings and drilling mud mixture feed on the screening surfaces.

47. The method of claim 46 wherein the pond region includes a portion of the screening surface at the feed receiving end of all three of the at least three screen decks so that when the pond is formed all three screening surfaces are submerged in the pond.

48. The method of claim 45 wherein the screening surface of each screen deck is in sealing engagement with the fluid retaining wall so that the drill cuttings and drilling mud mixture feed may be fully, or substantially fully, successively screened through each screen deck in turn.

49. The method of claim 45 wherein flow directing trays are absent from between screening surfaces in the pond region.

50. The method of claim 45 wherein flow directing trays are absent from between screening surfaces.

51. The method of claim 45 wherein the feed is applied from a conduit across the width or substantially across the width of the screening surface at the pond end.

52. The method of claim 45 wherein the feed is applied from a conduit shaped so as to direct the flow substantially horizontally or substantially in alignment with the slope of the uppermost screening surface in the direction of the solids discharge end of the screening surfaces.

53. The method of claim 52 wherein either:

the conduit is not connected to the basket; or at least the feed discharge end of the conduit is connected to the basket.

54. The method of claim 45 further comprising;

d) selecting screen mesh sizes and feed rate so as to control the height of the top surface of the fluid in the pond region on one screen deck at a higher level than the height of the top surface of the fluid in the pond region of a lower screen deck, in operation of the method.

55. The method of claim 45 further comprising:

d) selecting screen mesh sizes and feed rate so as to control the height of the top surface of the fluid in the pond region on each screen deck in the stack of three at a higher level than the height of the top surface of the fluid in the pond region of the next, lower, screen deck, in operation of the method.

56. The method of claim 46, wherein the shale shaker employed comprises:

a basket including a stack of at least three screen decks, each deck having a screening surface, with the screening surface of each deck spaced apart and superposed one above the other, wherein:

the screening surfaces of each of the three screen decks have a lower, feed receiving, end that is proximal to a fluid retaining wall of the basket and a distal, higher, solids discharge end;

wherein the screening surfaces of each of the three screen decks are each spaced apart, one from the next in the stack of three, by a spacing of from 20 mm to 120 mm, at their feed receiving ends.

* * * * *